US009563159B2

(12) United States Patent
Jota et al.

(10) Patent No.: US 9,563,159 B2
(45) Date of Patent: Feb. 7, 2017

(54) IMAGE HEATING APPARATUS AND ROTATABLE MEMBER FOR USE WITH THE IMAGE HEATING APPARATUS

(71) Applicant: CANON KABUSHIKI KAISHA, Tokyo (JP)

(72) Inventors: Yusuke Jota, Suntou-gun (JP); Shinji Hashiguchi, Mishima (JP); Yuki Nishizawa, Yokohama (JP); Tatsuya Kobayashi, Suntou-gun (JP); Koichi Hiroshima, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/570,291

(22) Filed: Dec. 15, 2014

(65) Prior Publication Data

US 2015/0168880 A1 Jun. 18, 2015

(30) Foreign Application Priority Data

Dec. 18, 2013 (JP) ..... 2013-261298

(51) Int. Cl.
*G03G 15/20* (2006.01)

(52) U.S. Cl.
CPC .. *G03G 15/2053* (2013.01); *G03G 2215/2035* (2013.01)

(58) Field of Classification Search
CPC ..... G03G 15/2053; G03G 15/2057; G03G 15/206
See application file for complete search history.

(56) References Cited

U.S. PATENT DOCUMENTS 6,687,482 B2 2/2004 Maeda et al.
7,122,768 B2 10/2006 Imai et al.
(Continued)

FOREIGN PATENT DOCUMENTS

CN 1504064 A 6/2004
JP 51-120451 A 10/1976
(Continued)

OTHER PUBLICATIONS

Oka et al. (JP 2005-100699 A), Apr. 2005, JPO Computer Translation.*
(Continued)

*Primary Examiner* — Erika J Villaluna
(74) *Attorney, Agent, or Firm* — Fitzpatrick, Cella, Harper & Scinto

(57) ABSTRACT

An image heating apparatus for heating an image formed on a recording material includes: a cylindrical rotatable member including a base layer and an electroconductive layer; a core inserted into the rotatable member; and a coil wound helically around the core inside the rotatable member, wherein an AC magnetic field is formed by passing an AC current through the coil to generate heat in the electroconductive layer through electromagnetic induction heating. The base layer has a volume resistivity higher than a volume resistivity of the base layer. The electroconductive layer generates heat through a full circumference thereof by a current flowing in a circumferential direction of the rotatable member independently of rotation of the rotatable member.

5 Claims, 14 Drawing Sheets

(56) References Cited

U.S. PATENT DOCUMENTS

| | | | |
|---|---|---|---|
| 7,190,914 | B2 | 3/2007 | Nihonyanagi et al. |
| 7,215,899 | B2 | 5/2007 | Kimizuka et al. |
| 7,251,447 | B2 | 7/2007 | Kanamori et al. |
| 7,280,775 | B2 | 10/2007 | Kubochi et al. |
| 7,518,089 | B2 | 4/2009 | Hashiguchi et al. |
| 8,068,757 | B2 | 11/2011 | Hashiguchi |
| 8,112,024 | B2 | 2/2012 | Saito et al. |
| 8,265,507 | B2 | 9/2012 | Saito et al. |
| 8,472,826 | B2 | 6/2013 | Hashiguchi |
| 8,606,164 | B2 | 12/2013 | Uekawa et al. |
| 2003/0113143 | A1 | 6/2003 | Maeda et al. |
| 2009/0028617 | A1 | 1/2009 | Katakabe et al. |
| 2014/0161498 | A1 | 6/2014 | Hashiguchi et al. |
| 2014/0161500 | A1 | 6/2014 | Kataoka et al. |

FOREIGN PATENT DOCUMENTS

| | | | | |
|---|---|---|---|---|
| JP | 52-139435 | A | | 11/1977 |
| JP | 8-129313 | A | | 5/1996 |
| JP | 2000081806 | A | | 3/2000 |
| JP | 2003-7438 | A | | 1/2003 |
| JP | 2003-122152 | A | | 4/2003 |
| JP | 2003330291 | A | | 11/2003 |
| JP | 2005100699 | A | * | 4/2005 |
| WO | 2006/098275 | A1 | | 9/2006 |

OTHER PUBLICATIONS

Office Action in Chinese Patent Application No. 201410789376.5, dated Sep. 2, 2016.

* cited by examiner (a)

(b)

(a)

(b)

(a)

(b)

(a)

(b)

(a)

(b)

IMAGE HEATING APPARATUS AND ROTATABLE MEMBER FOR USE WITH THE IMAGE HEATING APPARATUS

FIELD OF THE INVENTION AND RELATED ART

The present invention relates to an image heating apparatus, of an electromagnetic induction heating type, mounted in an image forming apparatus such as a copying machine or a printer of an electrophotographic type. Further, the present invention relates to a rotatable member for use with the image heating apparatus.

As the image heating apparatus, a heat fixing device for fixing or temporarily fixing an unfixed image, formed on a recording material, by heating the unfixed image and a glossiness increasing device (image modifying device) for increasing glossiness of an image by re-heating the image fixed on the recording material, and the like device can be used.

The image heating apparatus mounted in the image forming apparatus, such as the copying machine or the printer, of the electrophotographic type will be described as an example. In a conventional heat fixing device, fixing is made by passing the recording material supporting the unfixed image through a nip formed by a fixing roller (heat roller) and a pressing roller press-contacted to the fixing roller.

In recent years, as a heating method of the fixing roller, an electromagnetic induction heating type has been proposed (Japanese Laid-Open Patent Application (JP-A) Hei 8-129313). The electromagnetic induction heating type is capable of directly heating a material-to-be-heated, and therefore a temperature increasing speed is fast and a quick start property is excellent, so that the electromagnetic induction heating type is advantageous in shortening a print waiting time.

In the electromagnetic induction heating type, an exciting coil obtained by winding a wire on a magnetic material is provided inside the fixing roller, and an AC current is supplied to the exciting coil, so that an AC magnetic flux generated in the exciting coil is inducted into an inside of the magnetic material to form a magnetic path. Then, a constitution in which the current is generated by an electromotive force which is formed by an electroconductive member and which is induced inside the fixing roller and then the fixing roller is heated by Joule heat by the generated current has been proposed (JP-A Sho 51-120451 and JP-A Sho 52-139435).

In the constitution disclosed in the above-described documents (references), in the case where a warm-up time is intended to be further shortened, a method in which thermal capacity is made small by reducing a thickness of a base layer of the fixing roller which is a heat generating member would be considered. However, in the case where the base layer of the fixing roller is made excessively thin, strength of the fixing roller is insufficient and thus is liable to break, so that robustness lowers. As described above, the robustness and small thermal capacity are in a trade-off relationship, so that it was difficult to compatibly realize the robustness and the small thermal capacity.

SUMMARY OF THE INVENTION

According to a first aspect of the present invention, there is provided an image heating apparatus for heating an image formed on a recording material, comprising: a cylindrical rotatable member including a base layer and an electroconductive layer; a core inserted into the rotatable member; and a coil wound helically around the core inside the rotatable member, wherein an AC magnetic field is formed by passing an AC current through the coil to generate heat in the electroconductive layer through electromagnetic induction heating, wherein the base layer has a volume resistivity higher than a volume resistivity of the base layer, and wherein the electroconductive layer generates heat through a full circumference thereof by a current flowing in a circumferential direction of the rotatable member independently of rotation of the rotatable member.

According to a second aspect of the present invention, there is provided an image heating apparatus for heating an image formed on a recording material, comprising: a cylindrical rotatable member including a base layer and an electroconductive layer; a core inserted into the rotatable member; and a coil wound helically around the core inside the rotatable member, wherein an AC magnetic field is formed by passing an AC current through the coil to generate heat in the electroconductive layer through electromagnetic induction heating, wherein in a section from one end to the other end of a maximum passing region of the image on the recording material with respect to a generatrix direction of the rotatable member, a magnetic reluctance of the core is 30% or less of a combined magnetic reluctance of a magnetic reluctance of the electroconductive layer and a magnetic reluctance of a region between the electroconductive layer and the core.

According to a third aspect of the present invention, there is provided an image heating apparatus for heating an image formed on a recording material, comprising: a cylindrical rotatable member including a base layer and an electroconductive layer; a core, inserted into the rotatable member, having a shape such that a loop is not formed outside the electroconductive layer; and a coil wound helically around the core inside the rotatable member, wherein an AC magnetic field is formed by passing an AC current through the coil to generate heat in the electroconductive layer through electromagnetic induction heating, wherein 70% or more of magnetic flux coming out of one end of the core with respect to a generatrix direction of the rotatable member passes through an outside of the electroconductive layer and then returns to the other end of the core.

According to a fourth aspect of the present invention, there is provided a rotatable member for use with an image heating apparatus for heating an image formed on a recording material, the rotatable member comprising: an electroconductive layer; and a base layer lower in volume resistivity than the electroconductive layer; wherein the electroconductive layer is formed of austenitic stainless steel.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

(1) Image Forming Apparatus

Figure 2:
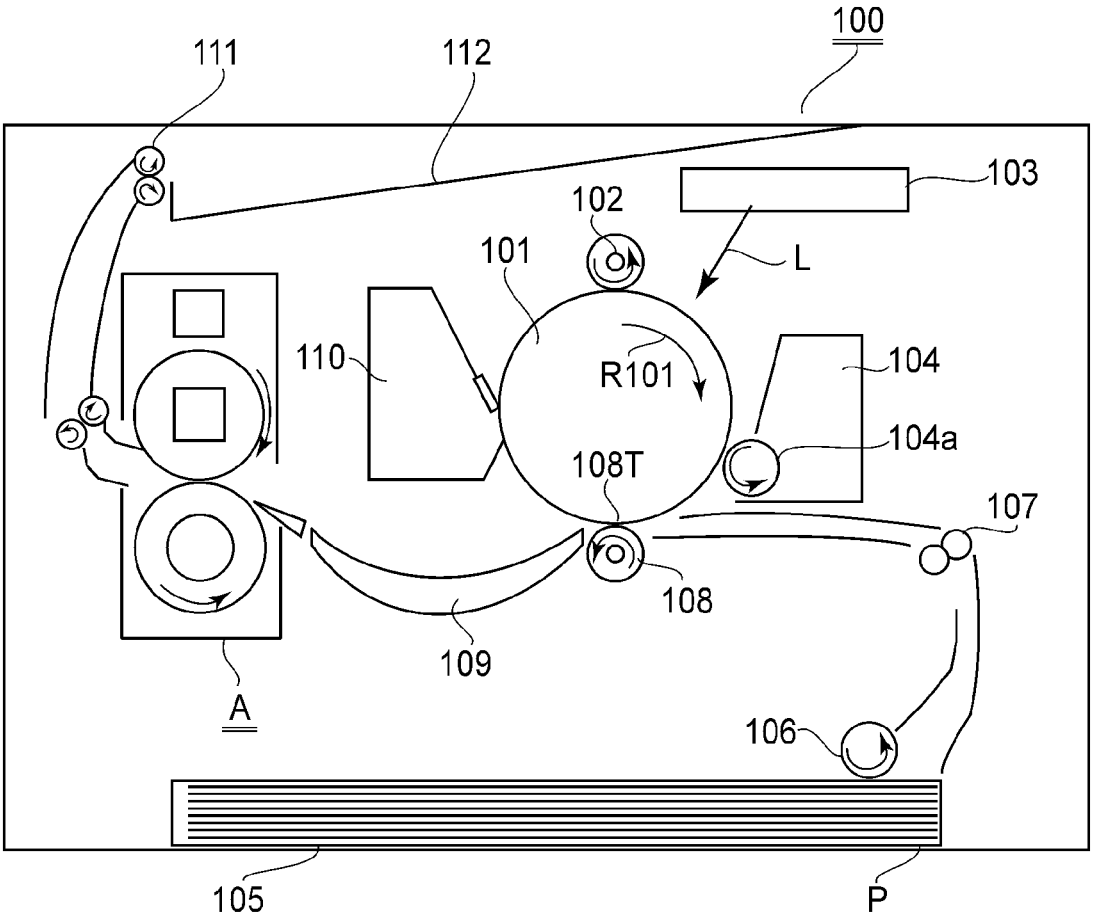
FIG. 2 is a schematic illustration of an image forming apparatus in Embodiment 1.

FIG. 2 is a schematic illustration of an example of an image forming apparatus in which an image heating apparatus according to the present invention is mounted as an image fixing device. An image forming apparatus 100 in this embodiment is a laser beam printer using a transfer-type electrophotographic process.

A rotatable drum-type electrophotographic photosensitive member (hereinafter referred to as a drum) as an image bearing member is rotationally driven at a predetermined peripheral speed in the clockwise direction indicated by an arrow R101. In a rotation process of the drum 101, the drum 101 is electrically charged uniformly to a predetermined polarity and a predetermined potential by a contact charging roller 102.

A laser beam scanner 103 was an image exposure means outputs laser light L ON/OFF-modulated correspondingly to a time-series electric digital pixel signal of image information inputted from an external device (host device) 1000 (FIG. 4) such as an image scanner or a computer into a control circuit (control means) 6. Then, the charged surface of the drum 101 is scanned (irradiated) with and exposed to the laser light L. By this scanning exposure, electric charges at an exposed light portion of the surface of the drum 101 are removed, so that an electrostatic latent image corresponding to objective image information is formed on the surface of the drum 101.

A developing device 104 includes a developing sleeve 104*a*. From the developing sleeve 104*a*, a developer (toner) is supplied to the surface of the drum 101, so that the electrostatic latent image on the surface of the drum 101 is successively developed into a toner image which is a transferable image.

A sheet feeding cassette 105 accommodates a recording material P as a recording medium stacked therein. The recording material P is a sheet-like member on which the toner image is formed by the image forming apparatus and includes, e.g., regular-sized or irregular-sized materials, such as plain paper, thick paper, thin paper, envelope, post card, seal, resin sheet, OHP sheet or glossy paper. These materials are hereinafter referred to as a sheet. Further, in description in this embodiment, for convenience, an operation of the sheet (recording material) P will be described using terms such as sheet passing, sheet discharge, sheet feeding, a sheet-passing portion and a non-sheet-passing portion, but the recording material is not limited to paper (sheet).

On the basis of a sheet feeding start signal, a sheet feeding roller 106 is driven, so that sheets P in the sheet feeding cassette 105 are separated and fed one by one. Then, the sheet P is introduced at predetermined timing to a transfer portion 108T, which is a contact nip between the drum 101 and a transfer roller 108 as a transfer member of a contact type and a rotatable type, via a registration roller pair 107. That is, feeding of the sheet P is controlled by the registration roller pair 107 so that a trailing end portion of the sheet P just reaches the transfer portion 108T at timing when a trailing end portion of the toner image on the drum 101 reaches the transfer portion 108T.

The sheet P introduced to the transfer portion 108T is nipped and fed through the transfer portion 108T, and during a feeding period, to the transfer roller 8, a transfer voltage (transfer bias) controlled at a predetermined level is applied from an unshown transfer bias applying power source. To the transfer roller 8, the transfer bias of an opposite polarity to a charge polarity of the toner is applied, so that the toner image is electrostatically transferred from the surface of the drum 101 onto the surface of the sheet P.

The sheet P on which the toner image (unfixed image) is transferred at the transfer portion 108T is separated from the surface of the drum 101 and is passed through a feeding guide 109 to be introduced into a heat fixing device (fixing device) A as the image heating apparatus. An image forming mechanism portion until the sheet P is fed to the fixing device A is an image forming portion for forming an unfixed image T (FIG. 4) on the sheet P. The device A will be specifically described in (2) below.

On the other hand, the surface of the drum 101 after the sheet separation (after the toner image transfer onto the sheet P) is cleaned by removing a transfer residual toner, paper dust or the like by a cleaning device. The sheet P passing through the fixing device A is discharged onto a sheet discharge tray 112 through a sheet discharging opening 111.

(2) Fixing Device 2-1) Schematic Structure

Figure 3:
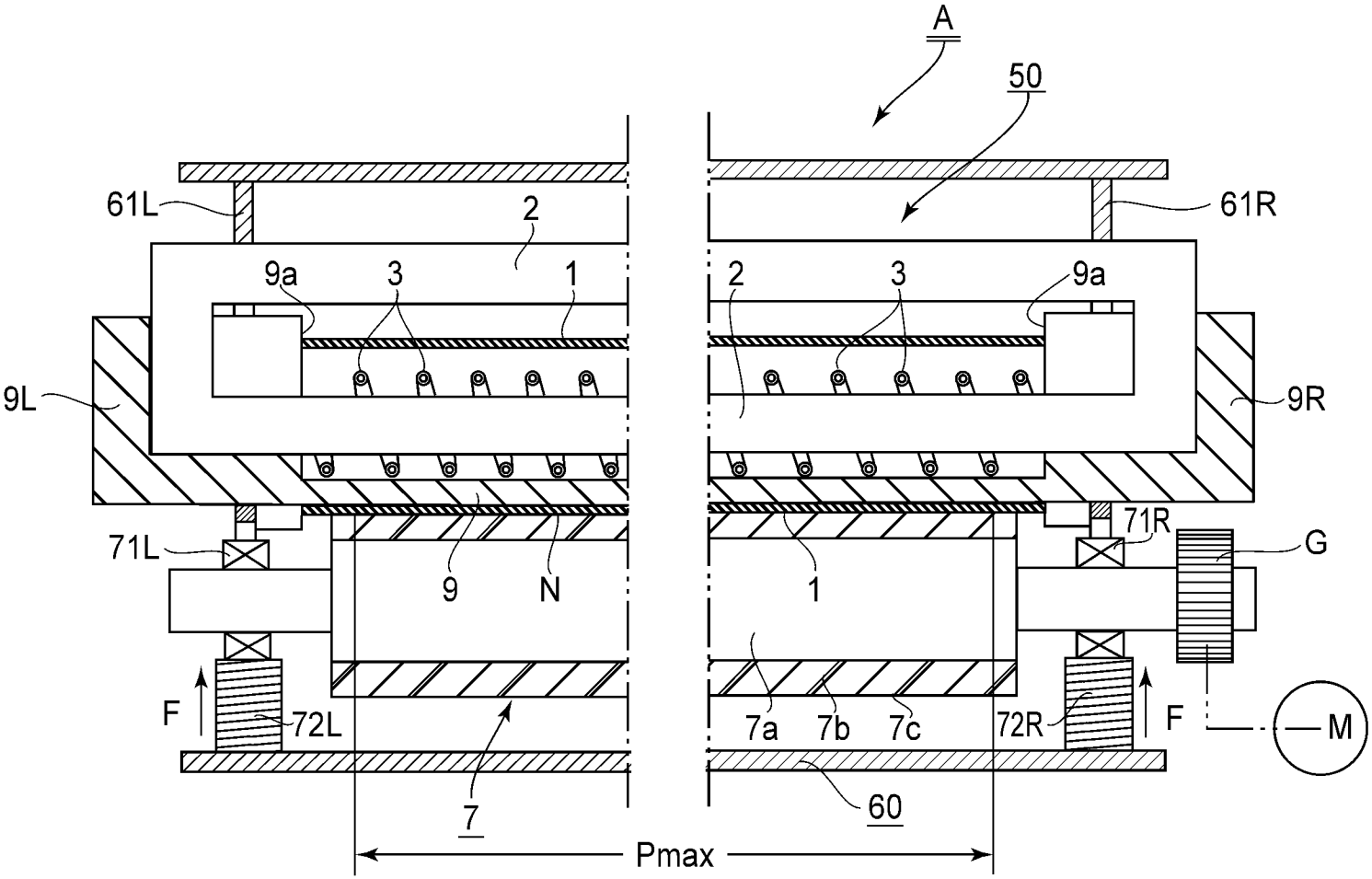
FIG. 3 is a schematic longitudinal front view of a fixing device in Embodiment 1, in which a halfway portion of the fixing device is omitted.
Figure 4:
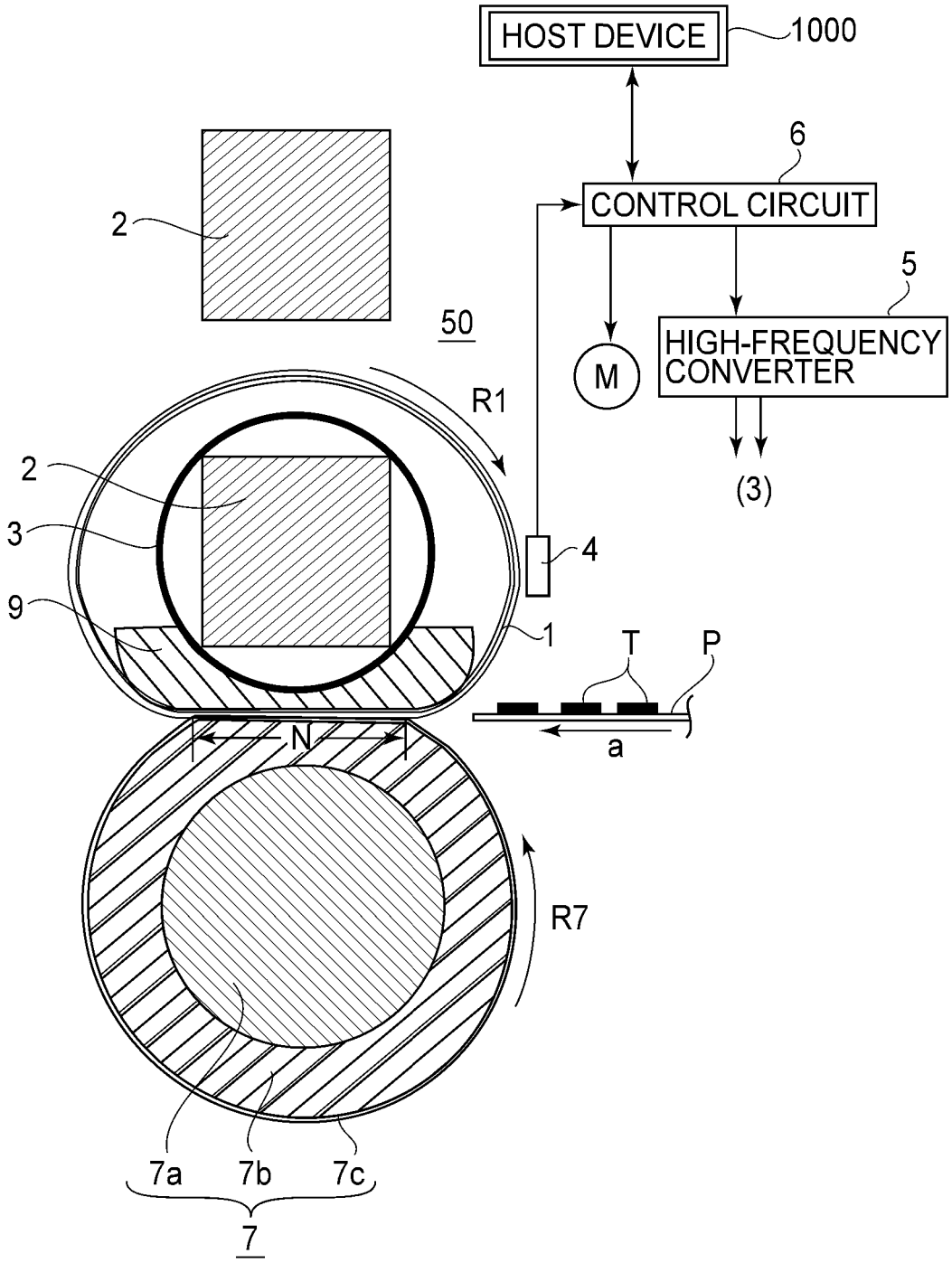
FIG. 4 includes an enlarged cross-sectional right side view of a principal part of the fixing device and a block diagram of a control system.

FIG. 3 is a schematic longitudinal front view of the fixing device A, in which a halfway portion of the fixing device A is omitted. FIG. 4 includes an enlarged cross-sectional right side view of a principal part of the fixing device A and a black diagram of a control system.

With respect to the fixing device A and constituent members thereof, a front (surface) side is a side (surface) where the fixing device A is seen from a sheet entrance side, and a rear (surface) side is a side (surface) (sheet exit side) opposite from the front side. Left and right are left (one end side) and right (the other end side) when the fixing device A is seen from the front side. Further, an upstream side and a downstream side are the upstream side and the downstream side with respect to a sheet feeding direction a (FIG. 4). A longitudinal direction (widthwise direction) and a sheet width direction are a direction substantially parallel to a direction perpendicular to the feeding direction a of the sheet P on a sheet feeding path surface. A short direction is a direction substantially parallel to the feeding direction a of the sheet P on the sheet feeding path surface.

The fixing device A is the image heating apparatus of an electromagnetic induction heating type, and is an elongated device extending in the longitudinal direction which is a left-right direction. The fixing device A roughly includes a heating unit 50, a pressing roller 7, having elasticity, as an opposing member for forming a nip N in press-contact with the heating unit 50, and a casing 60 in which the heating unit 50 and the pressing roller 7 are accommodated.

The heating unit 50 is an assembly of a fixing sleeve (fixing film: cylindrical rotatable member) 1 as a cylindrical image heating rotatable member, a fixing sleeve guide (film guide: nip-forming member) 9, a magnetic core 2, an exciting coil 3 and the like. The fixing sleeve 1 includes, as described later, an electroconductive layer (heat generating layer) for generating heat by the action of an AC magnetic field through electromagnetic induction heating. In this embodiment, the fixing sleeve 1 is the cylindrical rotatable member having flexibility as a whole.

The fixing sleeve guide 9 is constituted by a heat-resistant resin material such as PPS. The heating unit 50 is disposed so that left and right terminal structure portions 9L and 9R of the fixing sleeve guide 9 are positioned and fixed between left and right side plates 61L and 61R of the casing 60, respectively.

The pressing roller 7 is the opposing member for forming the nip N, in which the sheet P is nip-fed and heated, in cooperation with the fixing sleeve 1 as the image heating rotatable member, and is disposed substantially in parallel to the heating unit 50 in a side under the heating unit 50. Further, left and right terminal shaft portions of a core metal 7*a* are held and disposed rotatably between the left and right side plates 61L and 61R of the casing 60 via bearing members 71L and 71R, respectively, as bearing means.

The bearing members 71L and 71R are disposed slidably (movably) in a vertical (up-down) direction relative to the side plates 61L and 61R, respectively, and are pushed up and urged at a predetermined urging (pressing) force F by urging springs 72L and 72R, respectively as urging means (urging members). As a result, the pressing roller 7 is press-contacted to the fixing sleeve 1 toward a lower surface portion of the fixing sleeve guide 9 against elasticity of an elastic layer 7*b*.

In this embodiment, the pressing roller 7 is press-contacted as described above at an urging force of about 100 N to about 200 N (about 10 kgf to about 20 kgf) in terms of a total pressure. By this press contact, the elastic layer 7*b* of the pressing roller 7 is deformed, so that the nip (fixing nip) N having a predetermined width with respect to the sheet feeding direction a is formed between the fixing sleeve 1 and the pressing roller 7.

An operation of a fixing sequence (fixing process) of the fixing device A is as follows. A control (control means) 6 rotationally drives the pressing roller 7, as a rotatable driving member, at predetermined control timing in the counter-clockwise direction of an arrow R7 direction in FIG. 4 at a predetermined speed. The rotational drive of the pressing roller 7 is made by transmitting a driving force of a motor (driving source), controlled by the control circuit 6, to a driving gear G fixed on the right-side terminal shaft portion of the core metal 7*a* of the pressing roller 7.

The pressing roller 7 is rotationally driven, whereby a rotation torque acts on the fixing sleeve 1 at the nip N by a frictional force with the pressing roller 7. As a result, the fixing sleeve 1 is rotated by the pressing roller 7 at the peripheral speed substantially equal to the rotational peripheral speed of the pressing roller 7 in the clockwise direction of the arrow R1 around the assembly of the fixing sleeve guide 9, the exciting coil 3, the magnetic core 2 while sliding with the fixing sleeve guide 9 in close contact with the fixing sleeve guide 9 at an inner surface of the fixing sleeve 1. Left and right end surfaces of the fixing sleeve 1 are regulated (limited) by flange surfaces 9*a* (FIG. 3) of the left and right end portion structure portions 9L and 9R of the fixing sleeve guide 9. As a result, movement (meandering) of the fixing sleeve 1 in the longitudinal direction with the rotation of the fixing sleeve 1 is limited.

Further, the control circuit 6 passes a high-frequency current through the exciting coil 3 from a high-frequency converter (exciting circuit) 5. As a result, by the action of the generated AC magnetic field, an electroconductive layer 1*b*, described later, of the fixing sleeve 1 generates heat by electromagnetic induction heating, and is quickly heated and increased in temperature over an effective full length region. The temperature increase of the fixing sleeve 1 is detected by a temperature detecting element (temperature sensing element: thermistor) 4 provided opposedly in contact with or with a slight gap with the fixing sleeve 1 outside the fixing sleeve 1 substantially at a central portion of the fixing sleeve 1 with respect to the longitudinal direction (widthwise direction, generatrix direction) of the fixing sleeve 1. In this embodiment, for the temperature detecting element 4, a non-contact thermistor is used.

The control circuit 6 controls, on the basis of a fixing sleeve temperature detected by the temperature detecting element 4, electric power supplied from the high-frequency converter 5 to the exciting coil 3 so that the fixing sleeve temperature is increased up to and controlled at a predetermined target setting temperature (fixing temperature: e.g., about 150° C. to 200° C.).

Into the fixing device A, from the transfer portion 108T side, the sheet P carrying thereon the unfixed toner image T is introduced in a state in which a toner image carrying surface is directed upward. Incidentally, in FIG. 3, Pmax is a maximum sheet-passing region width (maximum feeding region width of the recording material) of the sheet P capable of being introduced into the fixing device A. Further, in a process in which the sheet P is nipped and fixed at the nip, the unfixed toner image is fixed as a fixed image on the sheet P by heat of the fixing sleeve 1 and pressure applied to the nip. The sheet P coming out of the nip N is sent to an outside from the fixing device A.

2-2) Fixing Sleeve

Figure 1:
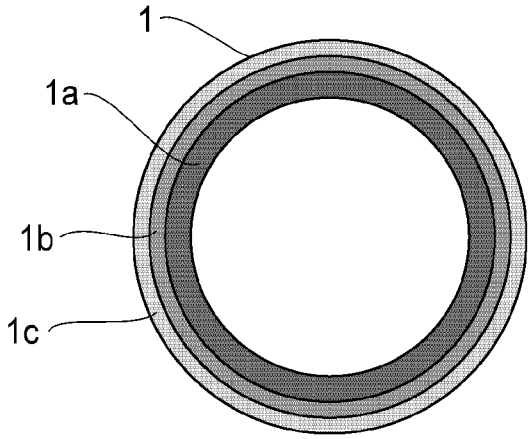
FIG. 1 is a schematic cross-sectional view showing a layer structure of a fixing sleeve in Embodiment 1.

FIG. 1 is a schematic cross-sectional view for illustrating a layer structure of the fixing sleeve 1 as the cylindrical image heating rotatable member. The fixing sleeve 1 is a member which is constituted to have a cross-sectional layer structure, from an inside thereof, consisting of a base layer 1*c*, an electroconductive layer (heat generating layer) 1*b* for generating heat through electromagnetic induction heating by the action of the magnetic field, and an outermost surface layer 1*c* and which has flexibility as a whole and a cylindrical shape in a free state. As a diameter of the fixing sleeve 1, 10 to 100 μm is suitable. In this embodiment, an outer diameter of the fixing sleeve 1 was 24 mm.

The fixing sleeve 1 as the cylindrical image heating rotatable member is, as described above, obtained by functionally separating the base layer 1*a* and the electroconductive layer 1*b* which is the heat generating layer for generating heat through electromagnetic induction heating by the action of the AC magnetic field, and then by forming the electroconductive layer 1*b* outside the base layer 1*a*. Then, a constitution in which a volume (electric) resistivity of a material for the base layer 1*a* is larger than a volume resistivity of a material for the electroconductive layer 1*b* is employed. Further, a constitution in which a specific gravity of the material for the base layer 1*a* is smaller than a specific gravity of the material for the electroconductive layer 1*b* is employed. By using such constitutions, it is possible to employ a constitution in which the base layer 1*a* is provided with a thickness to some extent and is formed of a material which does not so generate heat and in which the electroconductive layer 1*b* is formed in a thin layer, e.g., a metal layer.

Accordingly, it is possible to provide the fixing device capable of shortening a warm-up time while satisfying strength of the fixing sleeve 1 as the first heat rotatable member and capable of shortening the warm-up time without lowering robustness.

The structure of the fixing sleeve 1 will be described further specifically. As the material for the base layer 1*a*, a substance which has a non-magnetic property and a high volume resistivity and which is excellent in heat resistance is suitable. For example, there are heat-resistant resin materials represented by PI (polyimide) and PAI (polyamide imide) and fiber-reinforced resin materials represented by CFRP (carbon-fiber reinforced plastic) and GFRP (glass-fiber reinforced plastic), and the like resin materials.

The volume resistivity, specific gravity and a heat-resistant temperature of each of the respective substances described above are shown in Table 1 appearing hereinafter. A volume resistivity p is obtained by measuring a potential difference V at both ends of a sample member when a certain current I is supplied to the sample member having a cross-sectional area S and a length L and then by being calculated from the following calculating formula:

$$\rho=(V\times S)/(I\times L).$$

As the thickness of the base layer 1*a*, 20 to 200 μm is suitable. In this embodiment, the base layer 1*a* was formed of PI (polyimide) in the thickness of 60 μm.

On the outer surface of the base layer 1*a*, the electroconductive layer 1*b* is formed. The electroconductive layer 1*b* is the heat generating layer for generating heat through the electromagnetic induction heating by the action of the AC magnetic field. As a material for the electroconductive layer 1*b* as the heat generating layer, metal having a low volume resistivity is suitable. For example, there are gold, silver, copper, iron, platinum, tin, stainless steel (SUS), titanium, aluminum, nickel and the like. The volume resistivity and specific resistance of each of the respective substances described above are shown in Table 2 appearing hereinafter. As the material for the electroconductive layer 1*b* in this embodiment, a preferable material is copper, silver or austenitic stainless steel which are materials having low permeability. The reason therefor will be described later.

In comparison between Tables 1 and 2, volume resistivity values of all the materials (substances) shown in Table 1 are larger than volume resistivity values of all the materials (substances) shown in Table 2. Further, specific gravity values of all the materials shown in Table 1 are smaller than specific gravity values of all the materials shown in Table 2. Further, all the materials shown in Table 1 have high heat resistance.

Accordingly, by using, e.g., the material shown in Table 1 for the base layer 1*a* and, e.g., the material shown in Table 2 for the electroconductive layer 1*b*, it is possible to constitute the fixing sleeve 1 in the form such that the volume resistivity of the material for the base layer 1*a* is larger than the volume resistivity of the material for the electroconductive layer 1*b*. Further, it is possible to constitute the fixing sleeve 1 in the form such that the specific gravity of the material for the base layer 1*a* is smaller than the specific gravity of the material for the electroconductive layer 1*b*.

An example of a method of forming the electroconductive layer 1*b* will be described. A paint containing fine particles of the metal described above and a polyimide precursor solution is prepared, and then is applied onto the base layer 1*a* by a means such as a blade or screen printing. The resultant paint is gradually heated up to about 300-500° C. to be dried, so that polyimidization is caused to advance.

There is a proper range of the thickness of the electroconductive layer 1*b* depending on a loop resistance R of the electroconductive layer 1*b*. The loop resistance is calculated by a calculating formula of:

$$R=(\rho\times(\text{fixing sleeve electroconductive layer diameter})/((\text{fixing sleeve electroconductive layer thickness})\times(\text{fixing sleeve electroconductive layer width})).$$

When the loop resistance R is excessively high, a loop current does not pass through the electroconductive layer 1*b*, so that heat is not generated. When the loop resistance R is excessively low, the loop current flows but the resistance is small, and therefore a heat generation amount becomes small, so that a heat quantity necessary for the fixing cannot be generated. Therefore, the loop-resistance R of the electroconductive layer 1*b* has the proper range.

In this embodiment, the loop resistance R may suitably be 0.1 (mΩ) to 50 (mΩ). Therefore, the thickness may suitable be 0.1 μm to 50 μm in the case where the material for the electroconductive layer 1*b* is gold, silver, copper or aluminum, 0.5 μm to 150μ in the case of brass, and 5 μm to 200 μm in the case of SUS, nickel or titanium. In this embodiment, as the material for the electroconductive layer 1*b* silver was used, and the thickness was 5 μm.

Incidentally, in the fixing roller disclosed in JP-A Hei 8-129313, in the case where the thin metal electroconductive layer as in this embodiment is formed, a heat generation efficiency is poor, so that it is difficult to generate the heat quantity necessary for the fixing.

On the outer surface of the electroconductive layer 1*b*, a parting layer 1*c* is formed. The parting layer 1*c* is formed as an outermost functional layer for the purpose of preventing deposition of the toner onto the fixing sleeve 1 and generation of image defect.

As a material for the parting layer 1*c*, a substance excellent in non-adhesiveness is suitable. For example, there are PTFE (polytetrafluoroethylene), PFA (tetrafluoroethylene-perfluoroalkylvinyl ether copolymer), FEP (tetrafluoroethylene-hexafluoropropylene copolymer), ETFE (polyethylene-tetrafluoroethylene), ECTFE (ethylene-chlorotrifluoroethylene copolymer), and the like. In this embodiment, as the material for the parting layer 1*c*, PFA was used, and the thickness was 15 μm.

Incidentally, the fixing sleeve 1 can be more quickly increased in temperature with a smaller thermal capacity, and is advantageous for starting the fixing device A quickly. For that reason, it is desirable that the fixing sleeve 1 has a constitution in which the base layer 1*a*, the electroconductive layer 1*b* and the parting layer 1*c* are formed as thin layers to the possible extent and in which the diameter thereof is made small.

TABLE 1

| Substance | VR*1 (Ωm) | SG*2 | HRT*3 (° C.) |
|---|---|---|---|
| PI | $1.00 \times 10^{12}$ | 1.4 | 280 |
| PAI | $1.00 \times 10^{14}$ | 1.5 | 260 |
| CFGR | $1.00 \times 10^{12}$ | 1.6 | 250 |
| CFRP | $1.00 \times 10^{12}$ | 1.6 | 250 |

*1"VR" is the volume resistivity.
*2"SG" is the specific gravity.
*3"HRT" is the heat-resistant temperature.

TABLE 2

| Substance | VR*1 (Ωm) | SG*2 |
|---|---|---|
| Gold | $2.21 \times 10^{-8}$ | 19.3 |
| Silver | $1.59 \times 10^{-8}$ | 10.5 |
| Copper | $1.68 \times 10^{-8}$ | 8.8 |
| Iron | $1.00 \times 10^{-7}$ | 7.2 |
| Platinum | $1.04 \times 10^{-7}$ | 20.3 |
| Tin | $1.09 \times 10^{-7}$ | 7.4 |
| SUS | $7.20 \times 10^{-7}$ | 7.9 |
| Titanium | $4.27 \times 10^{-7}$ | 4.5 |
| Aluminum | $2.65 \times 10^{-8}$ | 2.7 |
| Nickel | $6.99 \times 10^{-8}$ | 8.7 |

*1"VR" is the volume resistivity.
*2"SG" is the specific gravity.

2-3) Magnetic Core

A relationship among the fixing sleeve 1, the magnetic core 2 and the exciting coil 3 will be described with reference to FIG. 3. The magnetic core 2 is inserted into the fixing sleeve 1 as the image heating rotatable member with respect to a rotational axis direction (longitudinal direction (widthwise direction, generatrix direction)) of the fixing sleeve 1. The magnetic core 2 forms a closed magnetic path by being wound around the fixing sleeve 1 once or more. That is, as shown in FIG. 3, the magnetic core 2 projects to an outside of an end surface of the fixing sleeve 1 with respect to the generatrix direction of the fixing sleeve 1 to from a loop outside the fixing sleeve 1.

Further, as shown in FIG. 3, the magnetic core 2 is disposed so that left and right end portions each projecting to the outside of the end surface of the fixing sleeve 1 are positioned and fixedly supported inside the fixing sleeve guide 9 by left and right end portion structure portions of the fixing sleeve guide 9. The cross-section of the magnetic core 2 has a rectangular shape, and the magnetic core 2 is disposed inside the fixing sleeve 1 substantially at a central portion.

Incidentally, in this embodiment, the magnetic path is formed as the closed magnetic path, but is not limited to the closed magnetic path, and may also be formed as an open magnetic path. That is, the magnetic core 2 may also be disposed only inside the fixing sleeve 1 and may also form the open magnetic path. In other words, the magnetic core 2 may also have a shape such that a loop is not formed outside the fixing sleeve 1.

The magnetic core 2 functions as a member for inducing magnetic lines of force (magnetic flux), by an AC magnetic field generated by the exciting coil 3, to an inside of the fixing sleeve 1 to form a path (magnetic path) of the magnetic lines of force. A material for the magnetic core 2 may desirably be a material having low hysteresis loss and high relative permeability or a high-permeability oxide or alloy material. For example, there are sintered ferrite, ferrite resin, amorphous alloy, permalloy, and the like.

It is desirable that the magnetic core 2 is configured to ensure a large cross-sectional area, to the possible extent within an accommodatable range, inside the fixing sleeve 1 which is a cylindrical member. The shape of the magnetic core 2 is not necessarily required to be a prism shape, but the magnetic core 2 may also be formed in a circular column shape. Further, the magnetic core 2 may also be divided into a plurality of cores with respect to the longitudinal direction so as to provide a gap (spacing) between adjacent cores, but at that time, it is desirable that a gap distance is minimized.

2-4) Exciting Coil

The exciting coil 3 is formed by helically winding an ordinary single lead wire around the magnetic core 2 in a winding number of 10 to 100 at a hollow portion of the fixing sleeve 1. In this embodiment, the winding number is 20. Inside the fixing sleeve 1 which is the cylindrical member, the lead wire is wound around the magnetic core 2 with respect to a direction crossing the rotational axis direction (generatrix direction of the fixing sleeve 1). For that reason, when a high-frequency current is passed through the exciting coil 3 via electric power supplying contact portions 3*a* and 3*b*, the magnetic field can be generated with respect to a direction parallel to an axis X of the fixing sleeve 1 as the cylindrical rotatable member.

That is, the fixing device A includes the fixing sleeve 1 having the above-described constitution. Further, the fixing device A includes the coil 3, which is disposed inside the fixing sleeve 1 and which has a helical portion where a helical axis is substantially parallel to the generatrix direction of the fixing sleeve 1, for generating an AC field for causing the electroconductive layer 1*b* of the fixing sleeve 1 to generate heat through electromagnetic induction heating. Further, the fixing device A includes the magnetic core 2, disposed in the helical portion of the coil, for inducing the magnetic lines of force of the AC magnetic field.

2-5) Temperature Control Means

Figure 5:
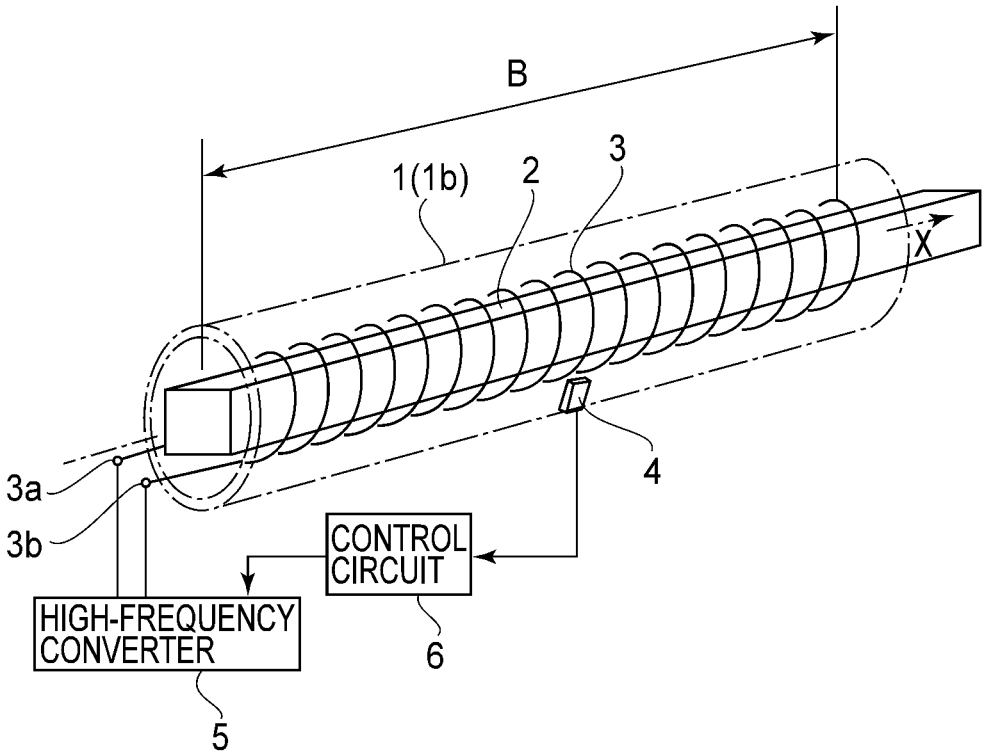
FIG. 5, FIG. 6 and (a) and (b) of FIG. 7 are illustrations of the fixing device.

The temperature detecting element 4 shown in FIGS. 4 and 5 is provided for detecting a surface temperature of the fixing sleeve 1. In this embodiment, as the temperature detecting element 4, a non-contact thermistor is used. The high-frequency converter 5 supplies a high-frequency current to the exciting coil 3 via the electric power supplying contact portions 3*a* and 3*b*. Further, from the viewpoint of a cost of electric power part (component), the frequency may preferably be low. Therefore, in this embodiment, frequency modulation control is effected in a region of 21 kHz to 40 kHz in the neighborhood of a lower limit of an available frequency band. The control circuit 6 controls the high-frequency converter 5 on the basis of the temperature detected by the temperature detecting element 4. As a result, the fixing sleeve 1 is heated by the magnetic induction heating, so that the surface temperature thereof is maintained and adjusted at a predetermined target temperature.

2-6) Pressing Roller

The pressing roller 7 includes a core metal 7*a*, an elastic layer 7*b* and a parting layer 7*c*. The pressing roller 7 is, as described above with reference to FIG. 3, disposed so that the fixing sleeve 1 is sandwiched between the pressing roller 7 and the fixing sleeve guide 9 while being press-contacted to the fixing sleeve 1 at a predetermined urging force by the slidable (movable) bearing members 71L and 71R and the urging members 72L and 72R. By the urging members 72L and 72R, the pressing roller 7 is press-contacted to the fixing sleeve 1, so that the elastic layer 7*b* of the pressing roller 7 is deformed and thus the nip N having a predetermined width is formed.

As a material for the core metal 7*a*, metal such as stainless steel (SUS), aluminum or iron is suitable. As a material for the elastic layer 7*b*, a silicone rubber, a fluorine-containing rubber or the like having heat resistance is suitable. Further, in order to improve a heat-insulating property, the elastic 7*b* of the pressing roller 7 may also be formed of the following material having low thermal capacity and the heat-insulating property. That is, the material includes a balloon rubber, such as a microballoon, in which a hollow filler is contained, a silicone rubber in which a water-absorbing polymer is contained, a sponge rubber in which the silicone rubber is subjected to water foaming, and the like.

The parting layer 7*c* is formed for the purpose of preventing deposition of an offset toner onto the pressing roller 7 and generation of image defect. As a material for the parting layer 7*c*, a substance excellent in non-adhesiveness is suitable.

For example, there are PTFE (polytetrafluoroethylene), PFA (tetrafluoroethylene-perfluoroalkylvinyl ether copolymer), FEP (tetrafluoroethylene-hexafluoropropylene copolymer), ETFE (polyethylene-tetrafluoroethylene), ECTFE (ethylene-chlorotrifluoroethylene copolymer), and the like.

Incidentally, in this embodiment, an outer diameter of the pressing roller 7 was 30 mm, and as the material for the core metal 7*a*, aluminum was used. The thickness of the elastic layer 7*c* was 3 mm, and the silicone rubber was used as the material for the elastic layer 7*b*. The thickness of the parting layer 7*c* was 30 μm, and a PFA tube was used as the material for the parting 7*c*.

Figure 6:
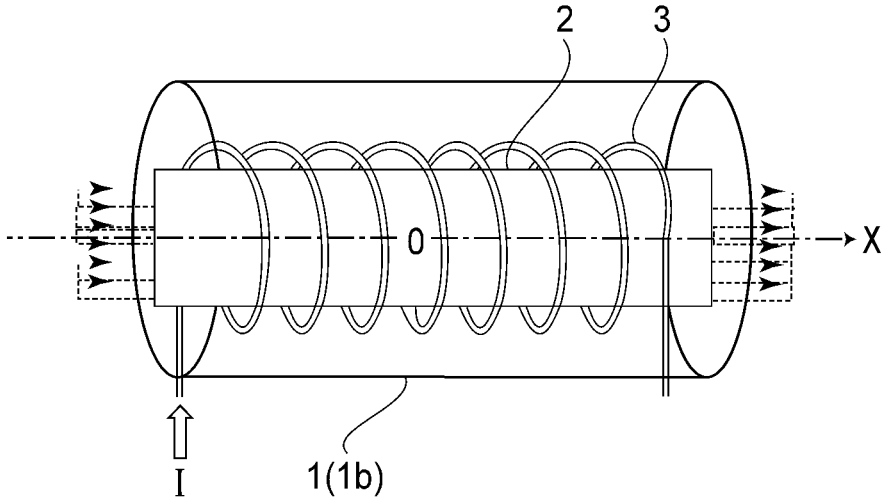

(3) Heat Generation Principle 3-1) Shape of Magnetic Lines of Force and Induced Electromotive Force First, a shape of magnetic lines of force will be described. FIG. 6 is a schematic view of a magnetic field in which a magnetic path is formed by inserting the magnetic core 2 as a ferromagnetic core material into a central portion of the exciting coil 3. Dotted lines and black arrows represent a direction of the magnetic lines of force. The direction of the magnetic lines of force in FIG. 6 is the direction at the instant when the current increases in an arrow I direction. The magnetic core 2 induces the magnetic lines of force generated by the exciting coil in the magnetic core 2, so that the magnetic path is formed.

3-2) Loop Current Inside Electroconductive Layer

Figure 7:
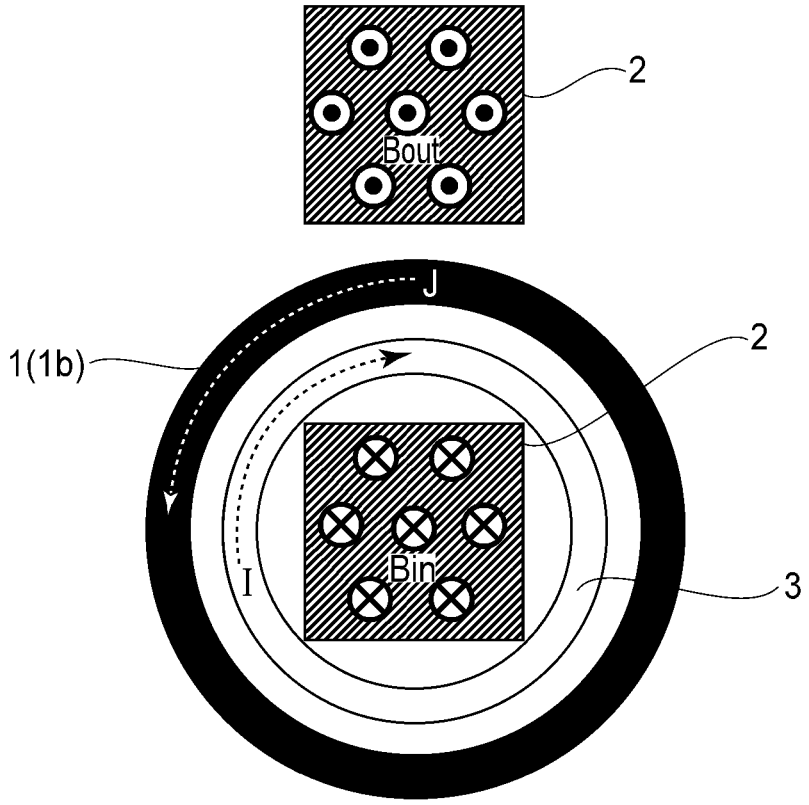
Figure 7:
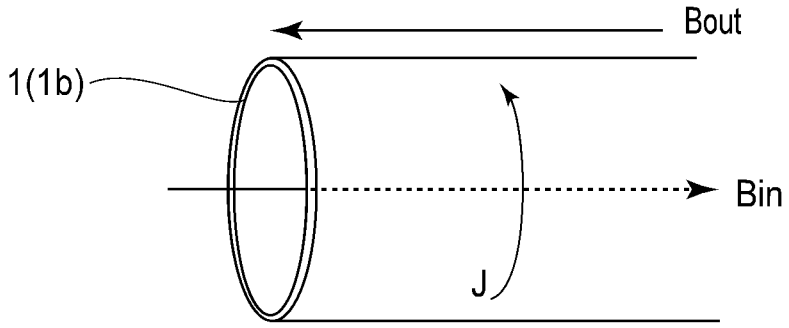

In FIG. 7, (a) is a schematic diagram of a cross-sectional structure of the magnetic core 2 and the exciting coil 3. From the center, the magnetic core 2, the exciting coil 3 and the fixing sleeve 1 as the cylindrical rotatable member are disposed concentrically, and when the current increases in the exciting coil 3 in the arrow I direction, the magnetic lines of force pass through the inside of the magnetic core 2. The magnetic lines of force Bin passing through the inside of the magnetic path are indicated by marks (x in ○) representing a direction in which the magnetic lines of force move toward a depth direction in the figure. Further, the magnetic lines of force Bout, passing through the magnetic core 2, disposed outside the fixing sleeve 1 are indicated by marks (• in ○) representing a direction in which the magnetic lines of force move toward a frontward direction in the figure.

The magnetic lines of force B in which are disposed inside the fixing sleeve 1 and which move toward the depth direction in the magnetic core 2 disposed inside the fixing sleeve 1 are returned toward the front direction in the magnetic core 2 disposed outside the fixing sleeve 1. At the instant when the current increases in the exciting coil 3 in the arrow I direction, the magnetic lines of force Bin are formed in the magnetic path. When the AC magnetic field is formed in actuality, the induced electromotive force is exerted over a full circumferential region of the electroconductive layer (heat generating layer) 1*b* of the fixing sleeve 1 so as to cancel the magnetic lines of force which are likely to be formed as described above, so that the current flows in an arrow J direction in the figure.

In FIG. 7, (b) is a longitudinal perspective view showing directions of the magnetic lines of force Bin passing through the inside of the magnetic core 2, the magnetic lines of force Bout returned outside the magnetic path, and a loop current J passing through the inside of the electroconductive layer 1*b* of the fixing sleeve 1. When the current passes through the electroconductive layer 1*b*, Joule heat is generated by an electric resistance of the electroconductive layer 1*b*, so that it is possible to cause the electroconductive layer 1*b* to generate heat.

(Effect Verification 1)

The fixing sleeve 1 in this embodiment (Embodiment 1) is, as described above, constituted from the inside by the base layer 1*a*, the electroconductive layer 1*b* generating heat by the action of the AC magnetic field through electromagnetic induction heating, and the outermost surface layer 1*c* in the listed order, and has the constitution in which the volume resistivity of the material for the base layer 1*a* is larger than the volume resistivity of the material for the electroconductive layer 1*b*. Specifically, as described above in 2-2), the base layer 1*a* is the 60 μm-thick PI (polyimide) layer, the electroconductive layer 1*b* is the 5 μm-thick silver layer, and the surface layer (parting layer) 1*c* is the 15 μm-thick PFA layer. The outer diameter of the fixing sleeve 1 is 24 mm.

In order to check a warm-up time shortening effect in the case where the fixing sleeve 1 in this embodiment, the following verification was made in comparison with the case where a fixing sleeve in Comparison Example 1 was used.

Figure 8:
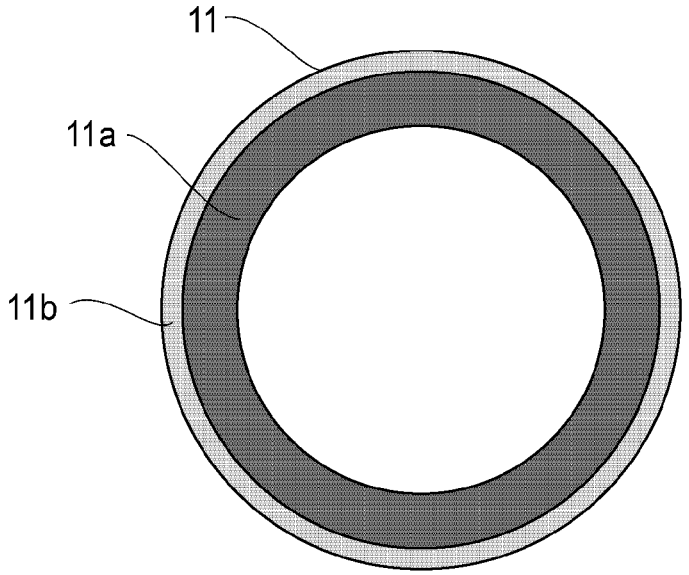
FIG. 8 is a schematic cross-sectional view showing a layer structure of a fixing sleeve in Comparison Example 1.

FIG. 8 is a sectional view of a fixing sleeve 11 used in Comparison Example 1. This fixing sleeve 11 has a layer structure in which the fixing sleeve 11 is constituted from the inside by a base layer 11*a* as an electroconductive layer generating heat by the action of the AC magnetic field through electromagnetic induction heating, and a surface layer 11*b* as a parting layer. The outer diameter of the fixing sleeve 11 was 24 mm.

As a material for the base layer 11*a* as the electroconductive layer of the fixing sleeve 11, SUS 304 (austenitic stainless steel) was used. The thickness of the base layer 11*a* was 30 μm. On the other surface of the base layer 11*a*, the surface layer 11*b* as the parting layer was formed. The surface layer 11*b* is formed for the purpose of preventing deposition of the toner onto the fixing sleeve 11 and generation of image defect. The surface layer 11*b* was formed on the base layer 11*a* by coating a PFA material on the base layer 11*a* in a thickness of 20 μm.

In the constitutions of Embodiment 1 and Comparison Example 1, the warm-up time from electric power-on until the temperature of the fixing sleeve reaches a print temperature was compared and thus the effect of Embodiment 1 was verified. In this verification, the print temperature was 150° C. This is because in the case where a fixing property was evaluated by changing the surface temperature of the fixing sleeve, when the surface temperature was 150° C., it was confirmed that the image can be fixed sufficiently.

Figure 9:
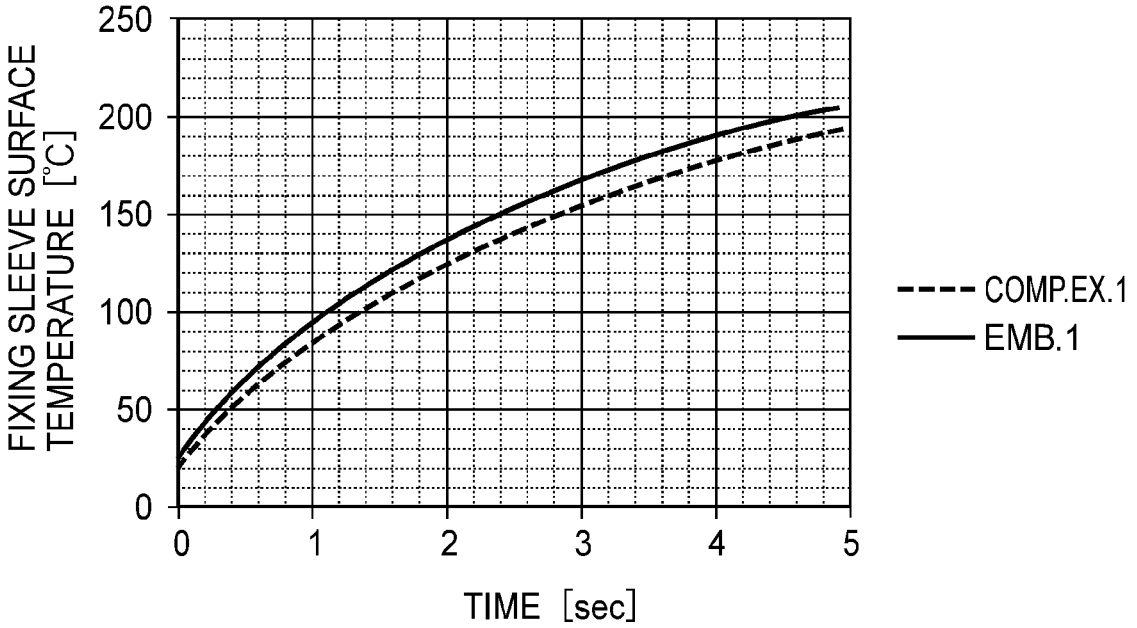
FIG. 9 is a graph of verification of an effect of the fixing sleeves in Embodiment 1 and Comparison Example 1.

A result of measurement of a change in surface temperature of the fixing sleeve with time in a state in which supplied electric power is 900 W is shown in FIG. 9. From FIG. 9, it is understood that an increasing speed of the surface temperature of the fixing sleeve is higher in Embodiment 1 than in Comparison Example 1.

Next, the warm-up time from the electric power-on until the fixing sleeve surface temperature reaches the print temperature was compared. A result thereof is shown in Table 3 appearing hereinafter. From Table 3, it is understood that the time until the fixing sleeve surface temperature reaches the print temperature in Embodiment 1 is shorter than in Comparison Example 1 by 0.4 sec. The reason therefor will be described below. When the thermal capacity is compared, the thermal capacity is 2.45 (J/K) in Comparison Example 1, whereas the thermal capacity is 2.19 (J/K) in Embodiment 1, and therefore the thermal capacity in Embodiment 1 is smaller by about 10% when compared with the thermal capacity in Comparison Example 1.

Next, a heat quantity necessary to increase the fixing sleeve surface temperature from a normal temperature (23° C.) to the print temperature (150° C.) was compared. Incidentally, in the constitution of Embodiment 1, in the case where the fixing sleeve surface temperature increased to 150° C., the temperature of the base layer of the fixing sleeve was 100° C., and therefore with respect to the base layer of the fixing sleeve, a heat quantity necessary to increase the base layer temperature from the normal temperature (23° C.) to 100° C. was calculated. As a result, the heat quantity is 180 (J) in the constitution of Embodiment 1, whereas the heat quantity is 310 (J) in the constitution of Comparison Example 1, so that it is understood that the necessary heat quantity is smaller in Embodiment 1 than in Comparison Example 1 by 130 (J). This heat quantity difference constitutes a factor such that the temperature was able to more quickly reach the print temperature in Embodiment 1 than in Comparison Example 1.

From the verification described above, it was confirmed that compared with Comparison Example 1, the warm-up time shortening effect was achieved in Embodiment 1.

TABLE 3

| | EMB. 1 | COMP. EX. 1 |
|---|---|---|
| TC*1 (J/K) | 2.19 | 2.45 |
| HQ*2 (J) | 180 | 310 |
| WUT*3 (sec) | 2.4 | 2.8 |

*1"TC" represents the thermal capacitance.
*2"HQ" represents the heat quantity necessary to increase the temperature from the normal temperature to the print temperature.
*3"WUT" represents the warm-up time.

Embodiment 2

In Embodiment 2, a constitution of an image forming apparatus, and a magnetic core, an exciting coil, a temperature control means and a pressing roller of a heat fixing device are the same as those in Embodiment 1, and therefore will be omitted from description.

The heat fixing device in this embodiment has a feature such that the base layer of the fixing sleeve has the thickness to some extent compared with the base layer of the fixing sleeve in the fixing device A of Embodiment 1 and that the fixing sleeve is not flexible. An object of this embodiment is to improve a durability of the fixing sleeve by eliminating a sleeve guide member, positioned inside the fixing sleeve, for regulating a locus of the fixing sleeve to eliminate sliding between the fixing sleeve and the sleeve guide member.

Figure 10:
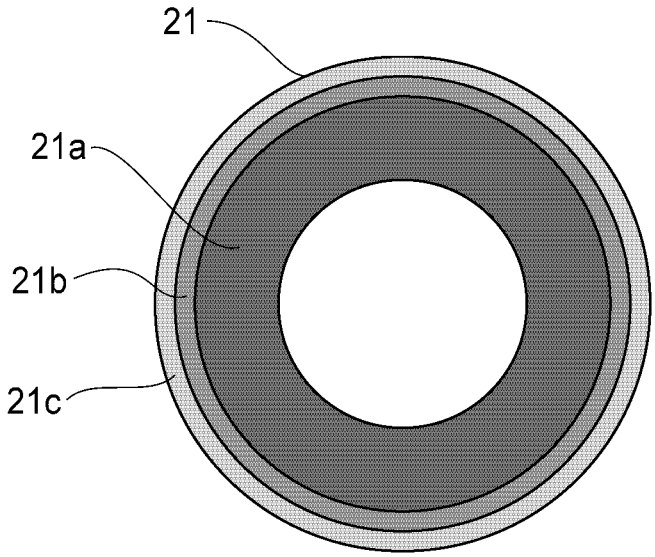
FIGS. 10 and 11 are schematic cross-sectional views showing layer structures of fixing sleeves in Embodiments 2 and 3, respectively.

FIG. 10 is a sectional view of a fixing sleeve 21 in this embodiment. Similarly as in the fixing sleeve 1 in Embodiment 1, the fixing sleeve 21 is constituted from the inside by a base layer 21*a*, an electroconductive layer 21*b* generating heat by the action of the AC magnetic field through the electromagnetic induction heating, and an outermost surface layer (parting layer) 21*c* in the listed order. The fixing sleeve 21 has a constitution in which the volume resistivity of the material for the base layer 21*a* is larger than the volume resistivity of the material for the electroconductive layer 21*b*. As the diameter of the fixing sleeve 21, 10 mm to 100 mm in suitable. In this embodiment, the outer diameter of the fixing sleeve 21 was 24 mm.

As the material for the base layer 21*a*, a substance similar to the material, for the base layer 1*a* of the fixing sleeve 1, described in Embodiment 1 is suitable. As the thickness of the base layer 21*a*, 0.2 mm to 10.0 mm is suitable. In this embodiment, the base layer 21*a* was formed of CFRP (carbon-fiber reinforced plastic) in the thickness of 1.0 mm.

Also with respect to the material and the thickness of the electroconductive layer 21*b*, they are similar to those, of the electroconductive layer 1*b* of the fixing sleeve 1, described in Embodiment 1. In this embodiment, as the material for the electroconductive layer (heat generating layer) 21*b*, silver was used, and the thickness was 5 μm.

Also with respect to the material and the thickness of the surface layer 21*c* as the parting layer, they are similar to those, of the surface layer 1*c* of the fixing sleeve 1, described in Embodiment 1. In this embodiment, as the material for the parting layer 21*c*, PFA was used, and the thickness was 15 μm.

Incidentally, the fixing sleeve 21 can be more quickly increased in temperature with a smaller thermal capacity, and is advantageous for starting the fixing device A quickly. For that reason, it is desirable that the fixing sleeve 21 has a constitution in which, the electroconductive layer 21*b* and the parting layer 21*c* are formed as thin layers to the possible extent and in which the diameter thereof is made small. It is desirable that also the base layer 21*a* is formed in a thin layer to the possible extent within a range capable of satisfying the durability.

(Effect Verification 2)

In order to check an effect of the fixing sleeve 21 in Embodiment 2, the following verification was made. The durability of the fixing sleeve was compared using the fixing sleeve 1 having the constitution in Embodiment 1 and the fixing sleeve 21 having the constitution described above in Embodiment 2. In both of the constitutions, a sheet passing durability test was conducted, and a degree of a deterioration of the fixing sleeve by the durability test. In this verification, a printer having a durable product lifetime of $150\times10^3$ sheets was used in the sheet passing durability test in which a print speed was 230 (mm/sec) and in which as the recording material, paper ("Extra 80 (g/cm$^2$)", available from Canon Marketing Japan Inc.) was used. A result thereof is shown in Table 4 appearing hereinafter.

In the constitution of Embodiment 1, it was confirmed that the passed sheet number was considerably larger than the durable product lifetime, but the base layer 1*a* was partly abraded (broken) by passing about $800\times10^3$ sheets through the fixing device. On the other hand, in the constitution of Embodiment 2, the base layer 21*a* was not abraded even when $1000\times10^3$ sheets were passed through the fixing device, so that it was confirmed that compared with the constitution of Embodiment 1, the constitution of Embodiment 2 was strong against the deterioration by the durability test. Incidentally, even in the case where the base layer 1*a* of the fixing sleeve 1 in Embodiment 1 was formed of GFRP (glass-fiber reinforced plastic), a similar effect to the effect in this verification was obtained. From the above verification, it was possible to confirm the effect of this embodiment (Embodiment 2).

TABLE 4

| | EMB. 1 | EMB. 2 | DPL*1 |
|---|---|---|---|
| PSN*2 | 800 | ≥1000 | 150 |

*1"DPL" represents the durable product lifetime ($\times 10^3$ sheets).
*2"PSN" represents the passed sheet number in the durability test ($\times 10^3$ sheets).

Embodiment 3

In Embodiment 3, a constitution of an image forming apparatus, and a magnetic core, an exciting coil, a temperature control means and a pressing roller of a heat fixing device are the same as those in Embodiment 1, and therefore will be omitted from description.

The heat fixing device in this embodiment has a feature such that the layer structure of the fixing sleeve is from the inside, a base layer, an elastic layer, an electroconductive layer and a surface layer. An object of this embodiment is to improve a fixing quality by forming the elastic layer between the base layer and the electroconductive layer to impart a toner covering effect at the nip N.

Figure 11:
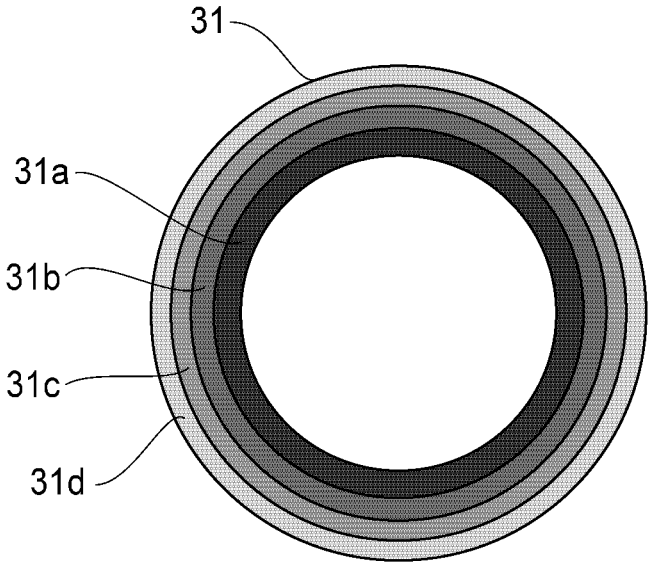

FIG. 11 is a sectional view of a fixing sleeve 31 in this embodiment. The fixing sleeve 31 in this embodiment is constituted from the inside by a base layer 31*a*, an elastic layer 31*b* an electroconductive layer 31*c* generating heat by the action of the AC magnetic field through the electromagnetic induction heating, and an outermost surface layer (parting layer) 31*d* in the listed order. The fixing sleeve 31 has a constitution in which the volume resistivity of the material for the base layer 31*a* is larger than the volume resistivity of the material for the electroconductive layer 31*c*. As the diameter of the fixing sleeve 31, 10 mm to 100 mm in suitable. In this embodiment, the outer diameter of the fixing sleeve 31 was 24 mm.

As the material for the base layer 31*a*, a substance similar to the material, for the base layer 1*a* of the fixing sleeve 1, described in Embodiment 1 is suitable. As the thickness of the base layer 31*a*, 20 μm to 10.0 mm is suitable. In this embodiment, the base layer 31*a* was formed polyimide in the thickness of 60 μm.

On the outer surface of the base layer 31*a*, the elastic layer 31*b* is formed. As the material for the elastic layer 31*b*, a rubber having a high heat-resistant temperature is suitable. For example, there are a silicone rubber, a fluorine-containing rubber, and the like. As the thickness of the elastic layer 31*b*. 30 μm to 5 mm is suitable. In this embodiment, as the material for the elastic layer 31*b*, the silicone rubber was used, and the thickness was 300 μm.

On the outer surface of the elastic layer 31*b*, the electroconductive layer 31*c* is formed. Also with respect to the material and the thickness of the electroconductive layer 31*c*, they are similar to those, of the electroconductive layer 1*b* of the fixing sleeve 1, described in Embodiment 1. In this embodiment, as the material for the electroconductive layer 31*c*, silver was used, and the thickness was 5 μm.

On the outer surface of the electroconductive layer 31*c*, the surface layer 31*d* as the parting layer is formed. Also with respect to the material and the thickness of the surface layer 21*c* as the parting layer, they are similar to those, of the surface layer 1*c* of the fixing sleeve 1, described in Embodiment 1. In this embodiment, the parting layer 31*d* was formed by coating PFA on the electroconductive layer 31*c*, and the thickness was 15 μm.

Incidentally, the fixing sleeve 31 can be more quickly increased in temperature with a smaller thermal capacity, and is advantageous for starting the fixing device A quickly. For that reason, it is desirable that the fixing sleeve 31 has a constitution in which the elastic layer 31*b*, the electroconductive layer 31*c* and the surface layer 31*d* are formed as thin layers to the possible extent and in which the diameter thereof is made small. It is desirable that also the base layer 31*a* is formed in a thin layer to the possible extent within a range capable of satisfying the durability. Incidentally, in this embodiment, the elastic layer 31*b* is formed between the base layer 31*a* and the electroconductive layer 31*c*, but may also be formed between the electroconductive layer 31*c* and the surface layer 31*d*.

(Effect Verification 3)

In order to check an effect of the fixing sleeve 31 in Embodiment 3, the following verification was made. The fixing quality was compared by subjecting the fixing sleeve 1 having the constitution in Embodiment 1 and the fixing sleeve 21 having the constitution described above in Embodiment 3 to a tape-peeling test. As an evaluation image, a solid black image of 5 mm×5 mm was used. As the recording material (sheet), paper ("Extra 80 (g/cm$^2$)", available from Canon Marketing Japan Inc.) was used. The recording material) was passed at a print speed of 230 (mm/sec) in a state in which the surface temperature of the fixing sleeve 31 was controlled at 150° C.

Onto the patch image, a polyester tape ("No. 5515", manufactured by Nichiban Co., Ltd.) was applied and was peeled off after a load of 200 gf is applied for 10 seconds from above the tape. Then, a lowering rate of an optical density before and after the peeling-off of the tape was compared. Measurement of the optical density was performed using a densitometer ("Spectro densitometer 504", manufactured by X-rite Inc.). The lowering rate of the optical density was calculated by a formula (1) below. In the peeling-off test, when the density lowering rate is 20% or less, the density lowering ratio is at a level of no problem on practical use. A comparison result is shown in Table 5 below.

(Density lowering test)=((Density before test)−(Density after test))/(density before test)×100

TABLE 5

| | EMB. 1 | EMB. 3 |
|---|---|---|
| DLR*1 (%) | 11.3 | 5.7 |

*1"DLR" represents the density lowering rate.

From Table 5, it is understood that in both of Embodiments 1 and 3, the density lowering rate is 20% or less and thus is at the level of no problem on practical use. Further, the density lowering rate in Embodiment 3 is low compared with Embodiment 1, so that it is understood that the fixing quality is improved in Embodiment 3. As the reason therefor, it would be considered that the fixing sleeve 31 in Embodiment 3 includes the elastic layer 31*b* thereby to impart a toner covering effect, and therefore the fixing quality is improved. In Embodiment 3, the elastic layer 31*b* was formed between the base layer 31*a* and the electroconductive layer 31*c*, but also in the case where the elastic layer 31*b* was formed between the electroconductive layer 31*c* and the surface layer 31*d*, a similar effect to the effect in this verification was achieved.

By the verification described above, it was confirmed that the constitution of Embodiment 3 had the effect of improving the fixing quality.

Other Embodiments

The Embodiments according to the present invention were described specifically above, but it is possible to replace various constitutions with other known constitutions within the scope of the concept of the present invention.

1) It is also possible to employ a device constitution in which the pressing roller 7 as the opposing member to the fixing sleeve 1 (21, 31) is disposed at a fixed position, and the nip N is formed by pressing and urging the fixing sleeve 1 (21, 31) against the pressing roller 7. Further, it is also possible to employ a device constitution in which both of the fixing sleeve 1 (21, 31) and the pressing roller 7 are pressed and urged against each other to form the nip N.

2) The opposing member to the fixing sleeve 1 (21, 31) is not limited to the roller member, but may also be a rotatable or rotationally movable endless belt.

3) It is also possible to employ a device constitution in which the fixing sleeve 1 (21, 31) is rotationally driven. In the case where the fixing sleeve 1 (21, 31) is rotationally driven, the opposing member for forming the nip N between itself and the fixing sleeve 1 (21, 31) can also be a non-rotatable member. For example, it is also possible to use the form of the non-rotatable member, such as a pad and a plate member, in which a friction coefficient of a surface which is a contact surface between the surface 1 (21, 31) and the recording material P.

4) The use of the image heating apparatus of the present invention is not limited to the use as the fixing device, as in the Embodiments described above, in which the unfixed toner image T carried on the recording material P is heat-fixed as the fixed image by being heated and pressed. The image heating apparatus is also effective as a heat treatment device for adjusting an image surface property such that glossiness of the image is improved by heating and pressing the image (fixed image or partly fixed image) which is once fixed or temporarily fixed on the recording material P.

5) The type of the image forming portion of the image forming apparatus is not limited to the electrophotographic type. The image forming portion may also be of an electrostatic recording type or a magnetic recording type. Further, the type is not limited to the transfer type but may also be a type using a constitution in which the unfixed image is formed on the recording material by using a direct type. The type may also be a type in which the image is formed on the recording material by using an ink jet type and then is fixed by heat-drying.

6) The fixing device A in the Embodiments described above may also be carried out in image forming apparatuses, other than the electrophotographic printer in the Embodiments, such as a color copying machine, a color facsimile machine, a color printer and a multi-function machine of these machines. That is, the fixing device and the electrophotographic printer in the Embodiments are not limited to combinations of the above-described constituent members, but may also be realized in other embodiments in which a part or all of the constituent members are replaced with alternative members thereof.

[Further Explanation of Fixing Devices of Embodiments]

(1) Heat-Generating Mechanism of Fixing Devices of Embodiments

With reference to (a) of FIG. 12, the heat-generating mechanism of the fixing devices A in Embodiments 1 to 3 will be described specifically. The fixing device A in Embodiment 1 will be described as a representative thereof.

The magnetic lines of force (indicated by dots) generated by passing the AC current through the coil 3 pass through the inside of the magnetic core 2 inside the electroconductive layer 1*b* of the fixing sleeve 1 in the generatrix direction (a direction from S toward N). Then, the magnetic lines of force move to the outside of the electroconductive layer 1*b* from one end (N) of the magnetic core 2 and return to the other end (S) of the magnetic core 2. As a result, the induced electromotive force for generating magnetic lines of force directed in a direction preventing an increase and a decrease of magnetic flux penetrating the inside of the electroconductive layer 1*b* in the generatrix direction of the electroconductive layer 1*b* is generated in the electroconductive layer 1*b*, so that the current is indicated along a circumferential direction of the electroconductive layer 1*b*.

By the Joule heat due to this induced current, the electroconductive layer 1*b* generates heat. A magnitude of the induced electromotive force V generated in the electroconductive layer 1*b* is proportional to a change amount per unit time ($\Delta\phi/\Delta t$) of the magnetic flux passing through the inside of the electroconductive layer 1*b* and the winding number of the coil as shown in the following formula (500).

$$V = -N\frac{\Delta\Phi}{\Delta t} \tag{500}$$

Figure 12:
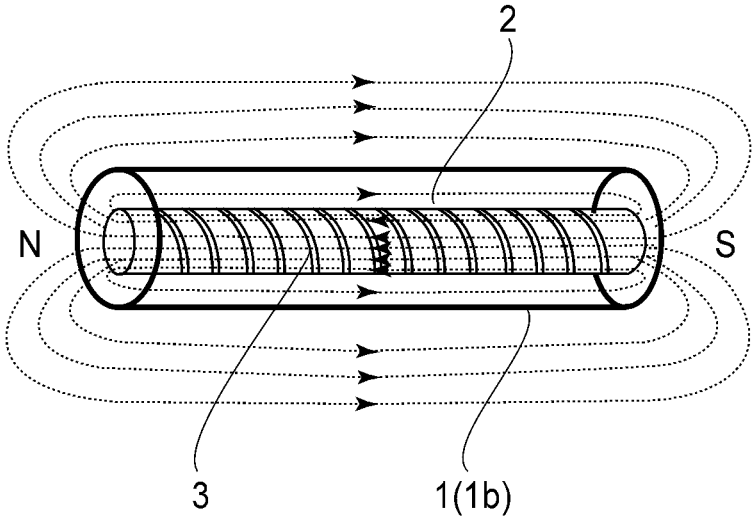
In FIG. 12, (a) and (b) are illustrations of a heat generating mechanism.
Figure 12:
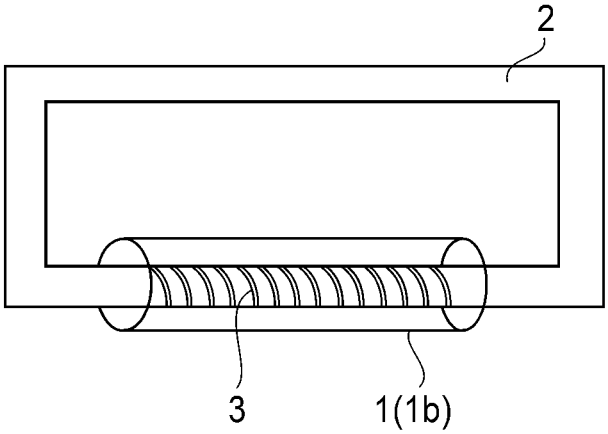

(2) Relationship Between Proportion of Magnetic Flux Passing Through Outside of Electroconductive Layer and Conversion Efficiency of Electric Power The magnetic core 2 in (a) of FIG. 12 does not form a loop and has a shape having end portions. As shown in (b) of FIG. 12, the magnetic lines of force in the fixing device A in which the magnetic core 2 forms a loop outside the electroconductive layer 1*b* come out from the inside to the outside of the electroconductive layer 1*b* by being induced in the magnetic core 2 and then return to the inside of the electroconductive layer 1*b*.

However, in the case of the constitution in which the magnetic core 2 has the end portions, the magnetic lines of force coming out of the end portions of the magnetic core 2 are not induced. For that reason, with respect to a path (from N to S) in which the magnetic lines of force coming out of one end of the magnetic core 2 return to the other end of the magnetic core 2, there is a possibility that the magnetic lines of force pass through both of an outside route in which the magnetic lines of force pass through the outside of the electroconductive layer 1*b* and an inside route in which the magnetic lines of force pass through the inside of the electroconductive layer 1*b*. Hereinafter, a route in which the magnetic lines of force pass through the outside of the electroconductive layer 1*b* from N toward S of the magnetic core 2 is referred to as the outside route, and a route in which the magnetic lines of force pass through the inside of the electroconductive layer 1*b* from N toward S of the magnetic core 2 is referred to as the inside route.

Of the magnetic lines of force coming out of one end of the magnetic core 2, a proportion of the magnetic lines of force passing through the outside route correlates with electric power (conversion efficiency of electric power), consumed by the heat generation of the electroconductive layer 1*b*, of electric power supplied to the coil 3, and is an important parameter. With an increasing proportion of the magnetic lines of force passing through the outside route, the electric power (conversion efficiency of electric power), consumed by the heat generation of the electroconductive layer 1*b*, of the electric power supplied to the coil 3 becomes higher.

The reason therefore is that a principle thereof is the same as a phenomenon that the conversion efficiency of the electric power becomes high when leakage flux is sufficiently small in a transformer and the number of magnetic fluxes passing through the inside of primary winding of the transformer and the number of magnetic fluxes passing through the inside of secondary winding of the transformer are equal to each other. That is, the conversion efficiency of the electric power becomes higher with a closer degree of the numbers of the magnetic fluxes passing through the inside of the magnetic core 2 and the magnetic fluxes passing through the outside route, so that the high-frequency current passed through the coil 3 can be efficiently subjected to, as the loop current, electromagnetic induction.

In (a) of FIG. 12, the magnetic lines of force passing through the inside of the magnetic core 2 from S toward N and the magnetic lines of force passing through the inside route are opposite in direction to each other, and therefore these magnetic lines of force are cancelled with each other as a whole induction the electroconductive layers 1*b* including the magnetic core 2. As a result, the number of magnetic lines of force (magnetic fluxes) passing through a whole of the inside of the electroconductive layer 1*b* form S toward N decreases, so that a change amount per unit time of the magnetic flux becomes small. When the change amount per unit time of the magnetic flux decreases, the induced electromotive force generated in the electroconductive layer 1*b* becomes small, so that a heat generation amount of the electroconductive layer 1*b* becomes small.

As described above, in order to obtain necessary electric power conversion efficiency by the fixing device A in the Embodiments, control of the proportion of the magnetic lines of force passing through the outside route is important.

(3) Index Indicating Proportion of Magnetic Flux Passing Through Outside of Electroconductive Layer The proportion passing through the outside route in the fixing device A is represented using an index called permeance representing ease of passing of the magnetic lines of force. First, a general way of thinking about a magnetic circuit will be described. A circuit of a magnetic path along which the magnetic lines of force pass is called the magnetic circuit relative to an electric circuit. When the magnetic flux is calculated in the magnetic circuit, the calculation can be made in accordance with calculation of the current in the electric circuit. To the magnetic circuit, the Ohm's law regarding the electric direction is applicable. When the magnetic flux corresponding to the current in the electric circuit is Φ, a magnetomotive force corresponding to the electromotive force is V, and a magnetic reluctance corresponding to an electrical resistance is R, these parameters satisfy the following formula (501).

$$\Phi=V/R \tag{501}$$

However, for describing the principle in an easy-to-understood manner, description will be made using permeance P. When the permeance P is used, the above formula (501) can be represented by the following formula (502).

$$\Phi=V\times P \tag{502}$$

Further, when a length of the magnetic path is B, a cross-sectional area of the magnetic path is S and permeability of the magnetic path is μ, the permeance P can be represented by the following formula (503).

$$P=\mu\times S/B \tag{503}$$

The permeance P is proportional to the cross-sectional area S and the permeability μ, and is inversely proportional to the magnetic path length B.

Figure 13:
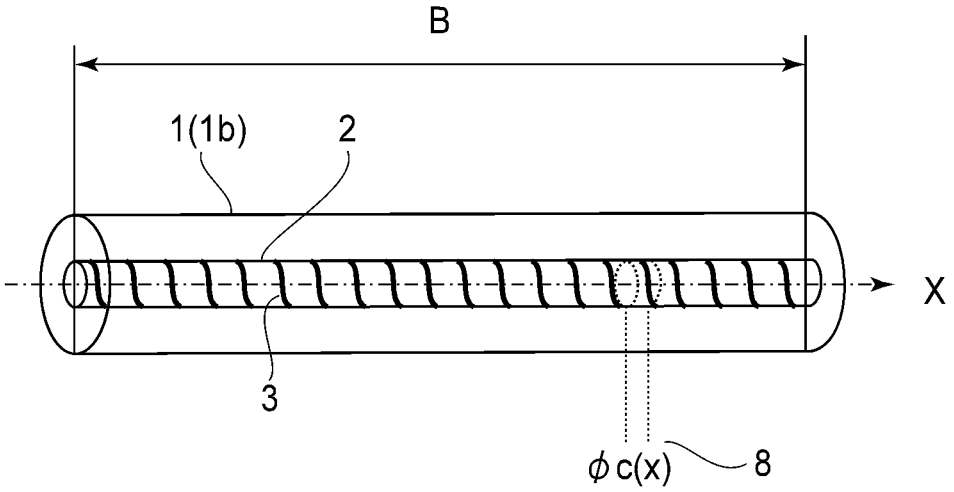
In FIG. 13, (a) and (b) are illustrations of the heat generating mechanism.
Figure 13:
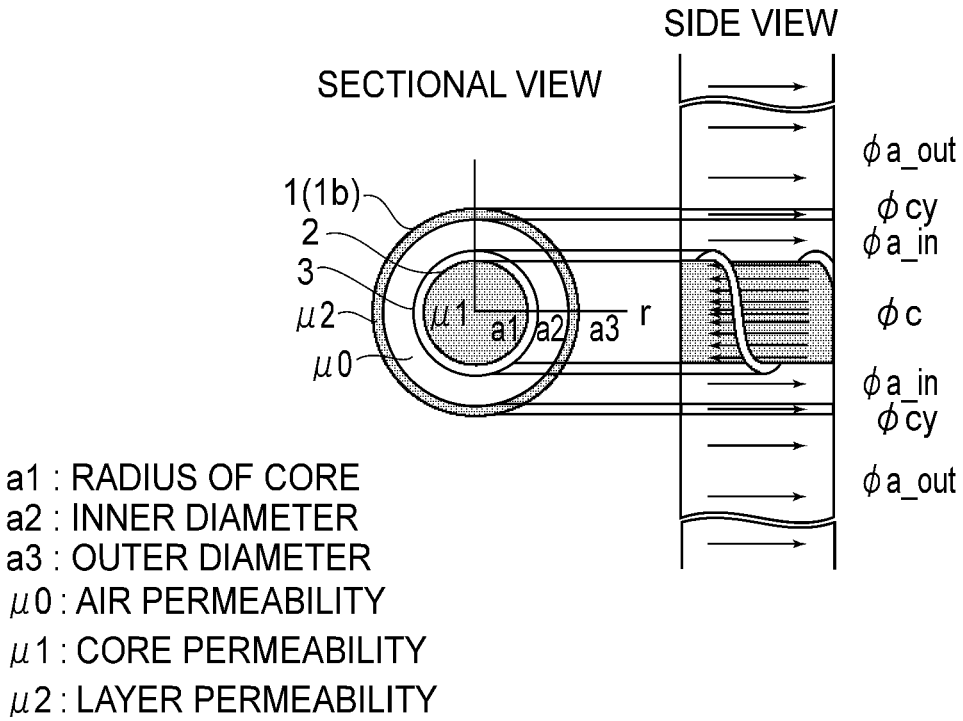

In FIG. 13, (a) is a schematic view showing the coil 3 wound N (times) around the magnetic core 2, of a1 (*m*) in radius, B (m) in length and μ1 in relative permeability, inside the electroconductive layer 1*b* in such a manner that a helical axis of the coil 3 is substantially parallel to the generatrix direction of the electroconductive layer 1*b*. In this case, the electroconductive layer 1*b* is an electroconductor of B (m) in length, a2 (*m*) in inner diameter, a3 (*m*) in outer diameter and μ2 in relative permeability. Space permeability induction and outside the electroconductive layer 1*b* is μ0 (H/m). When a current I (A) is passed through the coil 3, magnetic flux 8 generated per unit length of the magnetic core 2 is ϕc (x).

In FIG. 13, (b) is a sectional view perpendicular to the longitudinal direction of the magnetic core 2. Arrows in the figure represent magnetic fluxes, parallel to the longitudinal direction of the magnetic core 2, passing through the inside of the magnetic core 2, the induction of the electroconductive layer 1*b* and the outside of the electroconductive layer 1*b* when the current I is passed through the coil 3. The magnetic flux passing through the inside of the magnetic core 2 is c (=(ϕc(x)), the magnetic flux passing through the inside of the electroconductive layer 1*b* (in a region between the electroconductive layer 1*b* and the magnetic core 2) is ϕa_in, the magnetic flux passing through the electroconductive layer itself is ϕs, and the magnetic flux passing through the outside of the electroconductive layer is ϕa_out.

Figure 14:
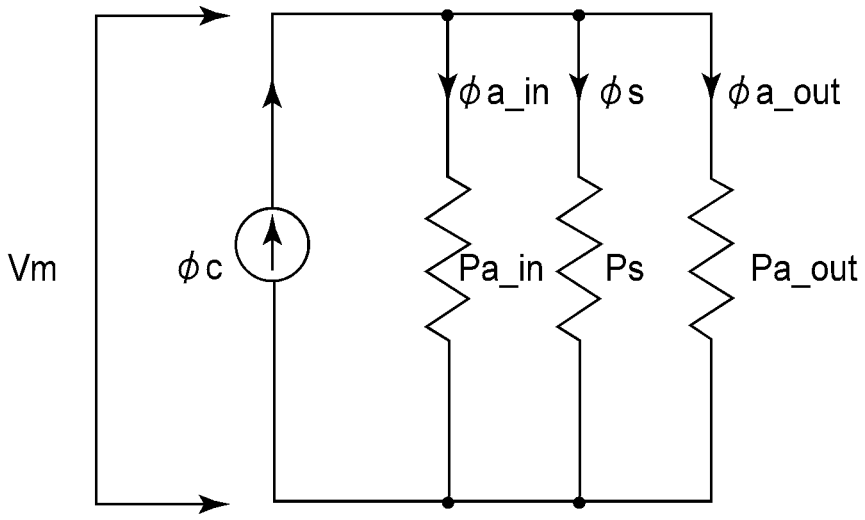
In FIG. 14, (a) and (b) show magnetic equivalent circuits.
Figure 14:
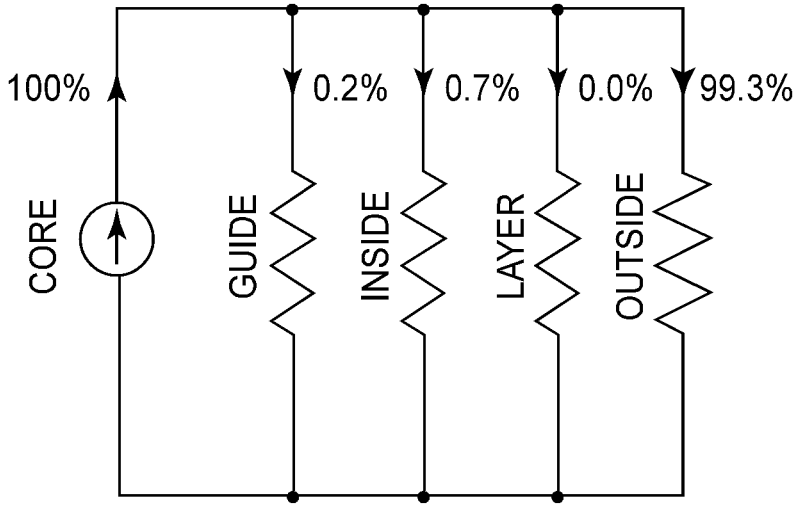

In FIG. 14, (a) shows a magnetic equivalent circuit in a space including the core 2, the coil 3 and the electroconductive layer 1*b* per unit length, which are shown in (a) of FIG. 12. The magnetomotive force generated by the magnetic flux ϕc passing through the magnetic core 2 is Vm, the permeance of the magnetic core 2 is Pc, and the permeance inside the electroconductive layer 1*b* is Pa_in. Further, the permeance in the electroconductive layer 1*b* itself of the fixing sleeve 1 is Ps, and the permeance outside the electroconductive layer 1*b* is Pa_out.

When Pc is large enough compared with Pa_in and Ps, it would be considered that the magnetic flux coming out of one end of the magnetic core 2 after passing through the inside of the magnetic core 2 returns to the other end of the magnetic core 2 after passing through either of ϕa_in, ϕs and ϕa_out. Therefore, the following formula (504) holds.

$$\phi c=\phi a_\mathrm{in}+\phi s+\phi a_\mathrm{out} \tag{504}$$

Further, ϕc, ϕa_in, ϕs and ϕa_out are represented by the following formulas (505) to (508), respectively.

$$\phi c=Pc\times Vm \tag{505}$$

$$Ps\times Vm \tag{506}$$

$$\phi a_\mathrm{in}=Pa_\mathrm{in}\times Vm \tag{507}$$

$$\phi a_\mathrm{out}=Pa_\mathrm{out}\times Vm \tag{508}$$

Therefore, when the formulas (505) to (508) are substituted into the formula (504), Pa_out is represented by the following formula (509).

$$Pc \times Vm = Pa_in \times Vm + Ps \times Vm + Pa_out \times Vm = (Pa_in + Ps + Pa_out) \times Vm \therefore Pa_out = Pc - Pa_in - Ps \quad (509)$$

When the cross-sectional area of the magnetic core 2 is Sc, the cross-sectional area inside the electroconductive layer 1*b* is Sa_in and the cross-sectional area of the electroconductive layer 1*b* itself is Ss, referring to (b) of FIG. 13, each of Pc, Pa_in and Ps can be represented by the product of "(permeability) x (cross-sectional area)" as shown below. The unit is "H·m".

$$Pc = \mu 1 \times Sc = \mu 1 \times \pi (a1)^2 \quad (510)$$

$$Pa_in = \mu 0 \times Sa_in = \mu 0 \times n \times ((a2)^2 - (a1)^2) \quad (511)$$

$$Ps = \mu 2 \times Ss = \mu 2 \times n \times ((a3)^2 - (a2)^2) \quad (512)$$

When the formulas (510) to (512) are substituted into the formula (509), Pa_out is represented by the following formula (513).

$$Pa_out = Pc - Pa_in - Ps = \mu 1 \times Sc - \mu 0 \times Sa_in - \mu 2 \times Ss = \pi \times \mu 1 \times (a1)^2 - \pi \times \mu 0 \times ((a2)^2 - (a1)^2) - \pi \times \mu 2 \times ((a3)^2 - (a2)^2) \quad (513)$$

By using the above formula (513), Pa_out/Pc which is a proportion of the magnetic lines of force passing through the outside of the electroconductive layer 1*b* can be calculated.

In place of the permeance P, the magnetic reluctance R may also be used. In the case where the magnetic reluctance R is used, the magnetic reluctance R is simply the reciprocal of the member P, and therefore the magnetic reluctance R per unit length can be expressed by "1/((permeability)× (cross-sectional area)), and the unit is "1/(H·m)".

A result of specific calculation using parameters of the device in the Embodiment is shown in Table 6.

TABLE 6

| Item | U*1 | MC*2 | FG*3 | IEL*4 | EL*5 | OEL*6 |
|---|---|---|---|---|---|---|
| CSA*7 | $m^2$ | 1.5E−04 | 1.0E−04 | 2.0E−04 | 1.5E−06 | |
| RP*8 | | 1800 | 1 | 1 | 1 | |
| P*9 | H/m | 2.3E−03 | 1.3E−06 | 1.3E−06 | 1.3E−06 | |
| PUL*10 | H.m | 3.5E−07 | 1.3E−10 | 2.5E−10 | 1.9E−12 | 3.5E−07 |
| MRUL*11 | 1/(H/m) | 2.9E+06 | 8.0E+09 | 4.0E+09 | 5.3E+11 | 2.9E+06 |
| MFR*12 | % | 100.0 | 0.0 | 0.1 | 0.0 | 99.9 |

*1"U" is the unit.
*2"MC" is the magnetic core.
*3"FG" is the film guide.
*4"IEL" is the inside of the electroconductive layer.
*5"EL" is the electroconductive layer.
*6"OEL" is the outside of the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.
*12"MFR" is the magnetic flux ratio.

The magnetic core 2 is formed of ferrite (relative permeability: 1800) and is 14 (mm) in diameter and $1.5\times10^{-4}$ ($m^2$) in cross-sectional area. The fixing sleeve guide 9 is formed of PPS (polyphenylene sulfide) (relative permeability: 1.0) and is $1.0\times10^{-4}$ ($m^2$) in cross-sectional area. The electroconductive layer 1*b* is formed of aluminum (relative permeability: 1.0) and is 24 (mm) in diameter, 20 (μm) in thickness and $1.5\times10^{-6}$ ($m^2$) in cross-sectional area.

The cross-sectional area of the region between the electroconductive layer 1*b* and the magnetic core 2 is calculated by subtracting the cross-sectional area of the magnetic core 2 and the cross-sectional area of the fixing sleeve guide 9 from the cross-sectional area of the hollow portion inside the electroconductive layer 1*b* of 24 mm in diameter. The surface layer 1*c* is provided outside the electroconductive layer 1*b* and does not contribute to the heat generation. Further, in Embodiment 3, the elastic layer 31*b* and the surface layer 31*d* are provided outside the electroconductive layer 31*c* in the case of the constitution in which the elastic layer 31*b* is formed between the electroconductive layer (heat generating layer) 31*c* and the surface layer 31*d*, and thus do not contribute to the heat generation. Accordingly, in a magnetic circuit model for calculating the permeance, the layers 1*c*, 31*b* and 31*d* can be regarded as air layers outside the electroconductive layer, and therefore there is no need to add the layers into the calculation.

From Table 6, Pc, Pa_in and Ps are values shown below. From a formula (514) shown below, Pa_out/Pc can be calculated using these values.

$$Pc = 3.5\times10^{-7} (H\cdot m)$$

$$Pa_in = 1.3\times10^{-10} + 2.5\times10^{-10} (H\cdot m)$$

$$Ps = 1.9\times10^{-12} (H\cdot m)$$

$$Pa_out/Pc = (Pc - Pa_in - Ps)/Ps = 0.999 (99.9\%) \quad (514)$$

The magnetic core 2 is divided into a plurality of cores with respect to the longitudinal direction, and a spacing (gap) is provided between adjacent divided cores in some cases. In the case where this spacing is filled with the air or a material of which relative permeability can be regarded as 1.0 or of which relative permeability is considerably smaller than the relative permeability of the magnetic core 2, the magnetic reluctance R of the magnetic core 2 as a whole becomes large, so that the function of inducing the magnetic lines of force degrades.

A calculating method of the permeance of the magnetic core 2 divided in the plurality of cores described above becomes complicated. In the following, a calculating method of the permeance of a whole of the magnetic core 2 in the case where the magnetic core 2 is divided into the plurality of cores which are equidistantly arranged via the spacing or the sheet-like non-magnetic material will be described. In this case, the magnetic reluctance over a longitudinal full length is derived and then is divided by the longitudinal full length to obtain the magnetic reluctance per unit length, and thereafter there is a need to obtain the permeance per unit length using the reciprocal of the magnetic reluctance per unit length.

Figure 15:
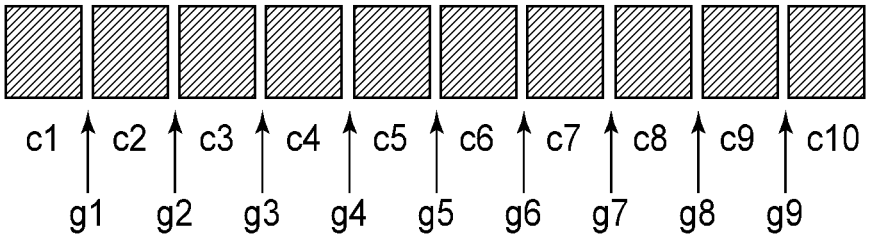
FIG. 15 is an illustration of the case where a magnetic core is divided into a plurality of portions.

First, a schematic view of the magnetic core 2 with respect to the longitudinal direction is shown in FIG. 15. Each of magnetic cores c1 to c10 is Sc in cross-sectional area, μc in permeability and Lc in width, and each of gaps g1 to g9 is Sg in cross-sectional area, μg in permeability and Lg in width. A total magnetic reluctance Rm_all of these magnetic cores with respect to the longitudinal direction is given by the following formula (515).

$$Rm_all = (Rm_C1 + Rm_c2 + \ldots + Rm_C10) + (Rm_g1 + Rm_g2 + \ldots + Rm_g9) \quad (515)$$

In this case, the shape, the material and the gap width of the respective magnetic cores are uniform, and therefore when the sum of values of Rm_c is ΣRm_c, and the sum of values of Rm_g is ΣRm_g, the respective magnetic reluctances can be represented by the following formulas (516) to (518).

$$Rm_all = (\Sigma Rm_c) + (\Sigma Rm_g) \quad (516)$$

$$Rm_c = Lc/(\mu c \times Sc) \quad (517)$$

$$Rm_g = Lg/(\mu g \times Sg) \quad (518)$$

By substituting the formulas (517) and (518) into the formula (516), the magnetic reluctance Rm_all over the longitudinal full length can be represented by the following formula (519).

$$\mathrm{Rm_all} = \left(\sum \mathrm{Rm_c}\right) + \left(\sum \mathrm{Rm_g}\right) = (Lc/(\mu c \times Sc)) \times 10 + (Lg/(\mu g \times Sg)) \times 9 \quad (519)$$

When the sum of values of Lc is ΣLc and the sum of values of Lg is ΣLg, the magnetic reluctance Rm per unit length is represented by the following formula (520).

$$Rm = \mathrm{Rm_all}/\left(\sum Lc + \sum Lg\right) = \mathrm{Rm_all}/(L \times 10 + Lg \times 9) \quad (520)$$

From the above, the permeance Pm per unit length is obtained from the following formula (521).

$$Pm = \frac{1}{Rm} = \frac{\left(\sum Lc + \sum Lg\right)}{\mathrm{Rm_all}} = \frac{\left(\sum Lc + \sum Lg\right)}{[\{\sum Lc/(\mu c + Sc)\} + \{\sum Lg/(\mu g + Sg)\}]} \quad (521)$$

An increase in gap Lg leads to an increase in magnetic reluctance (i.e., a lowering in permeance) of the magnetic core 2. When the fixing device A in the Embodiment is constituted, on a heat generation principle, it is desirable that the magnetic core 2 is designed so as to have a small magnetic reluctance (i.e., a large permeance), and therefore it is not so desirable that the gap is provided. However, in order to prevent breakage of the magnetic core 2, the gap is provided by dividing the magnetic core 2 into a plurality of cores in some cases.

As described above, the proportion of the magnetic lines of force passing through the outside route can be represented using the permeance or the magnetic reluctance.

Further, according to the heat generation principle of the electroconductive layer 1*b* of the fixing device described above, it is preferable that the electroconductive layer 1*b* is low in permeability and small in thickness. This is because the permeance of the electroconductive layer 1*b* becomes small, and thus the proportion of the magnetic lines of force which come out of one end of the magnetic core 2 and which pass through the outside of the electroconductive layer 1*b* and then return to the other end of the magnetic core increases, so that the electric power efficiency is improved.

Further, in this embodiment, the base layer 1*a* has the function of ensuring mechanical strength of the fixing sleeve 1, and therefore the thickness of the electroconductive layer 1*b* performing the function of heat generation is easily made smaller than the thickness of the base layer 1*a*.

However, when the thickness of the electroconductive layer 1*b* becomes thin, the thermal capacity of the electroconductive layer 1*b* becomes small, and therefore although warm-up is quick, supply of the heat quantity is too late for the heat treatment and thus improper fixing generates in some cases. Particularly, in a constitution in which eddy current passes partly through the electroconductive layer 1*b* with respect to a circumferential direction and thus the electroconductive layer 1*b* locally generates heat, the improper fixing is liable to generate. Therefore, as in this embodiment, the constitution in which the heat can be generated over a full circumference of the electroconductive layer 1*b* has the advantage such that the improper fixing does not readily generate even when the electroconductive layer 1*b* is thin. Accordingly, by the constitution in this embodiment, it is possible to realize improvement in rigidity of the fixing sleeve, shortening of the warm-up time and suppression of the improper fixing.

(4) Conversion Efficiency of Electric Power Necessary for Fixing Device

Next, the conversion efficiency of the electric power necessary for the fixing device A in this embodiment will be described. For example, in the case where the conversion efficiency of the electric power is 80%, the remaining 20% of the electric power is converted into thermal energy by the coil, the core and the like, other than the electroconductive layer, and then is consumed. In the case where the electric power conversion efficiency is low, members, which should not generate heat, such as the magnetic core and the coil generate heat, so that there is a need to take measures to cool the members in some cases.

Incidentally, in this embodiment, when the electroconductive layer 1*b* is caused to generate heat, the AC magnetic field is formed by passing the high-frequency current through the exciting coil 3. The AC magnetic field induces the current in the electroconductive layer 1*b*. As a physical model, this closely resembles magnetic coupling of the transformer. For that reason, when the electric power conversion efficiency is considered, it is possible to use an equivalent circuit of the magnetic coupling of the transformer. By the magnetic field, the exciting coil 3 and the electroconductive layer 1*b* cause the magnetic coupling, so that the electric power supplied to the exciting coil 3 is transmitted to the electroconductive layer 1*b*. Herein, the "electric power conversion efficiency" means a ratio between the electric power supplied to the exciting coil which is the magnetic field generating means and the electric power consumed by the electroconductive layer.

In the case of this embodiment, the electric power conversion efficiency is the ratio between the electric power supplied to the high-frequency converter 5 for the exciting coil 3 shown in FIGS. 4 and 5 and the electric power consumed by the electroconductive layer 1*b*. The electric power conversion efficiency can be represented by the following formula (522).

(Electric power conversion efficiency)−(electric power consumed by electroconductive layer)/(electric power supplied to exciting coil) (522)

The electric power which is supplied to the exciting coil 3 and which is then consumed by members other than the electroconductive layer 1*b* includes loss by the resistance of the exciting coil 3 and loss by a magnetic characteristic of the magnetic core material.

Figure 16:
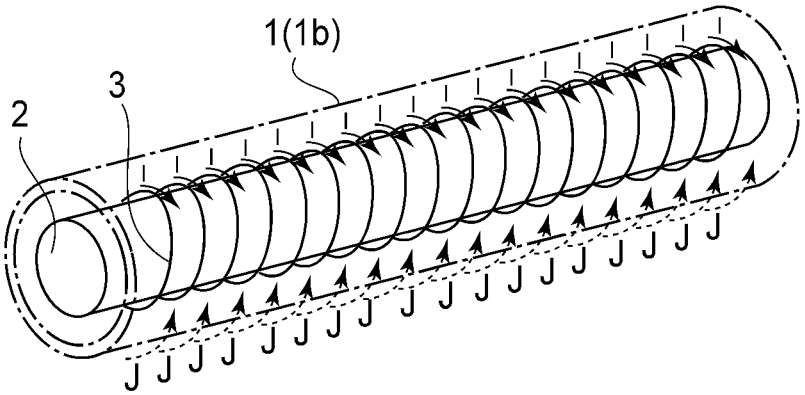
In FIG. 16, (a) and (b) are illustrations relating to an efficiency of a circuit.
Figure 16:
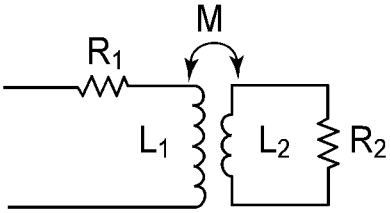

In FIG. 16, (a) and (b) are illustrations regarding an efficiency of a circuit. In (a) of FIG. 16, the exciting coil 3 is wound around the magnetic core 2 disposed induction the electroconductive layer 1*b*. In FIG. 16, (b) shows an equivalent circuit. In (b) of FIG. 16, R1 is loss due to the exciting coil 3 and the magnetic core 2, L1 is an inductance of the exciting coil 3 wound around the magnetic core 2, M is a mutual inductance between the winding and the electroconductive layer 1*b*, L2 is an inductance of the electroconductive layer 1*b*, and R2 is a resistance of the electroconductive layer 1*b*.

Figure 17:
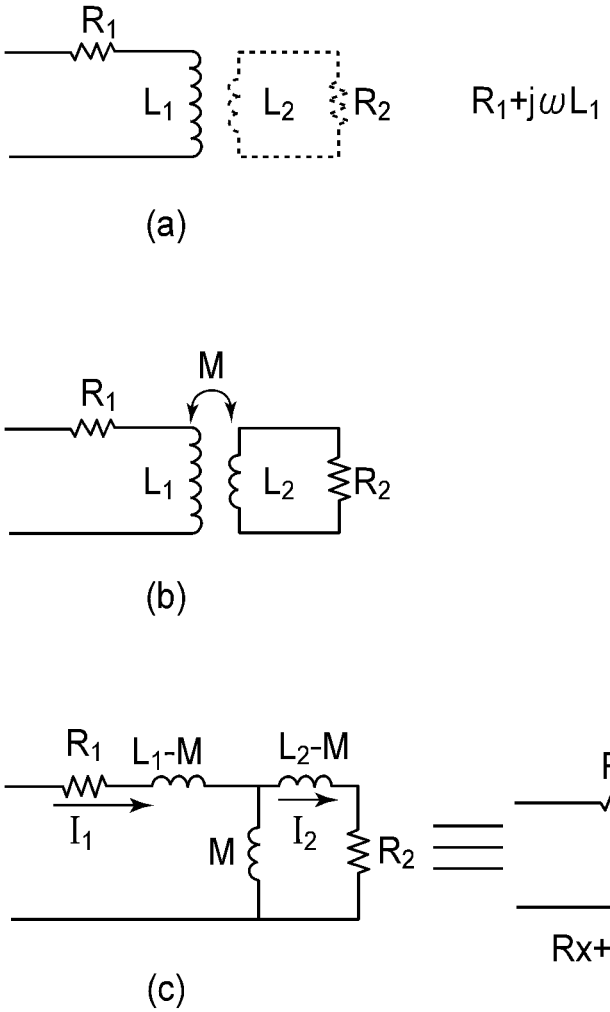
In FIG. 17, (a), (b) and (c) show equivalent circuits.

An equivalent circuit when the fixing sleeve 1 including the electroconductive layer 1*b* is not mounted is shown in (a) of FIG. 17. By a device such as an impedance analyzer or an LCR meter, when a series equivalent resistance R1 and an equivalent inductance L1 are measured from both ends of the exciting coil 3, an impedance ZA can be represented by the following formula (523).

$$ZA=R1+j\omega L1$$

The current passing through this circuit produces loss by R1. That is, R1 represents the loss due to the coil 3 and the magnetic core 2.

An equivalent circuit when the fixing sleeve 1 including the electroconductive layer 1*b* is shown in (b) of FIG. 17. When a series equivalent resistance Rx and an equivalent inductance Lx during mounting of the fixing sleeve 1 including the electroconductive layer 1*b* are measured in advance, by making equivalent conversion as shown in (c) of FIG. 17, it is possible to obtain a relational expression (524).

$$Z = R1 + j\omega(L1 - M) + \frac{j\omega M(j\omega(L2 - M) + R2)}{j\omega M + j\omega(L2 - M) + R2} \tag{524}$$

$$= R1 + \frac{\omega^2 M^2 R_2}{R_2^2 + \omega^2 L_2^2} + j(\omega(L_1 - M) + \frac{M \cdot R_2^2 + \omega^2 M L_2(L_2 - M)}{R_2^2 + \omega^2 L_2^2}$$

$$Rx = R_1 + \frac{\omega^2 M^2 R_2}{R_2^2 + \omega^2 L_2^2} \tag{525}$$

$$Lx = \omega(L_1 - M) + \frac{M \cdot R_2^2 + \omega^2 M L_2(L_2 - M)}{R_2^2 + \omega^2 L_2^2} \tag{526}$$

In the above formulas, M represents a mutual inductance between the exciting coil and the electroconductive layer.

As shown in (c) of FIG. 17, when a current passing through R1 is I1 and a current passing through R2 is I2, the following formula (527) holds.

$$j\omega M(I_1 - I_2) = (R_2 + j\omega(L_2 - M))I_2 \tag{527}$$

From the formula (527), the following formula (528) can be derived.

$$I_1 = \frac{R_2 + j\omega L_2}{j\omega M} I_2 \tag{528}$$

The efficiency (electric power conversion efficiency) is represented by (electric power consumption of resistance R2)/(electric power consumption of resistance R1)+(electric power consumption of resistance R2)), and therefore can be represented by the following formula (529).

$$\text{Power conversion efficiency} = \frac{R_2 \times |I_2^2|}{R_1 \times |I_1^2| + R_2 \times |I_2^2|} \tag{529}$$

$$= \frac{\omega^2 M^2 R_2}{\omega^2 L_2^2 R_1 + R_1 R_2^2 + \omega^2 M^2 R_2}$$

-continued $$= \frac{Rx - R_1}{Rx}$$

When the series equivalent resistance R1 before the mounting of the fixing sleeve 1 including the electroconductive layer 1*b* and the series equivalent resistance Rx after the mounting of the fixing sleeve 1 including the electroconductive layer 1*b* are measured, the electric power conversion efficiency showing a degree of consumption of the electric power, in the electroconductive layer 1*b*, of the electric power supplied to the exciting coil 3. In this embodiment, for measurement of the electric power conversion efficiency, an impedance analyzer ("4294A", manufactured by Agilient Technologies).

First, in a state in which there was no fixing sleeve 1, the series equivalent resistance R1 from the both ends of the winding was measured, and then in a state in which the magnetic core 2 around which the exciting coil 3 was wound was inserted into the fixing sleeve 1, the series equivalent resistance Rx from the both ends of the winding was measured. As a result, R1=103 mΩ and Rx=2.2Ω, so that the electric power conversion efficiency at this time can be obtained as 95.3% from the formula (529). Hereinafter, a performance of the fixing device will be evaluated using this electric power conversion efficiency.

Figure 18:
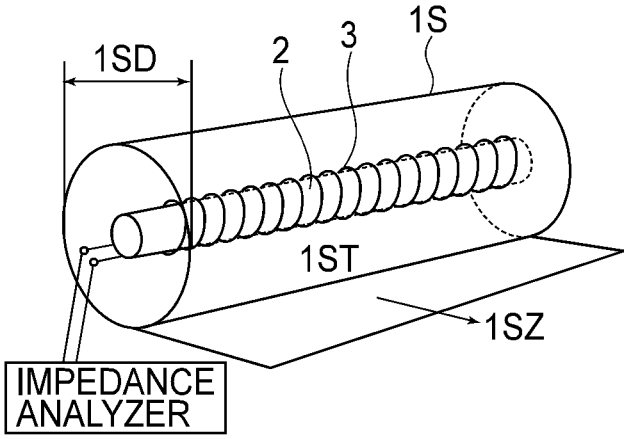
FIG. 18 is an illustration showing an experimental device used in a measurement experiment of a conversion efficiency of electric power.

Here, the electric power conversion efficiency necessary for the fixing device will be obtained. The electric power conversion efficiency is evaluated by changing the proportion of the magnetic flux passing through the outside route of the electroconductive layer 1*b*. FIG. 18 is a schematic view showing an experimental device used in a measurement test of the electric power conversion efficiency.

A metal sheet 1S is an aluminum-made sheet of 230 mm in width, 600 mm in length and 20 μm in thickness. This metal sheet 1S is rolled up in a cylindrical shape so as to enclose the magnetic core 2 and the coil 3, and is electrically conducted at a portion 1ST to prepare an electroconductive layer.

The magnetic core 2 is ferrite of 1800 in relative permeability and 500 mT in saturation flux density, and has a cylindrical shape of 26 $mm^2$ in cross-sectional area and 230 mm in length. The magnetic core 2 is disposed substantially at a central (axis) portion of the cylinder of the aluminum sheet 1S by an unshown fixing means. Around the magnetic core 2, the coil is helically wound 25 times in winding number.

When an end portion of the metal sheet 1S is pulled in an arrow 1SZ direction, a diameter 1SD of the electroconductive layer can be adjusted in a range of 18 mm to 191 mm.

Figure 19:
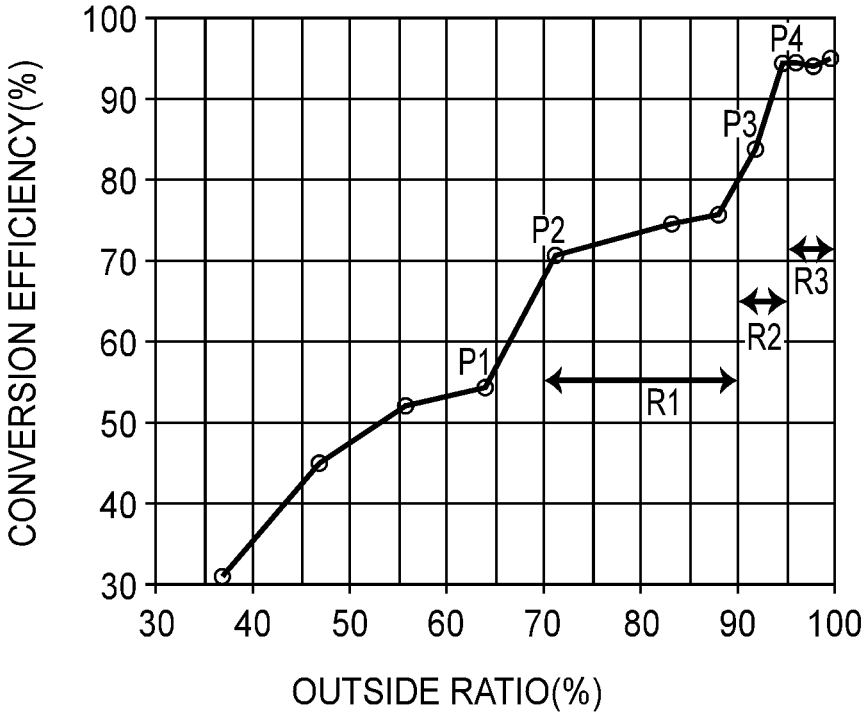
FIG. 19 is a graph in which the abscissa represents a ratio (%) of magnetic flux passing through an outside route of an electroconductive layer, and the ordinate represents the conversion efficiency of the electric power at a frequency of 21 kHz.

FIG. 19 is a graph in which the abscissa represents a ratio (%) of the magnetic flux passing through the outside route of the electroconductive layer, and the ordinate represents the electric power conversion efficiency (%) at a frequency of 21 kHz. In the graph of FIG. 19, the electric power conversion efficiency abruptly increases from a plot P1 and then exceeds 70%, and is maintained at 70% or more in a range R1 indicated by a double-pointed arrow. In the neighborhood of P3, the electric power conversion efficiency abruptly increases again and exceeds 80% in a range R2. In a range R3 from P4, the electric power conversion efficiency is stable at a high value of 94% or more. The reason why the electric power conversion efficiency abruptly increases is that the loop current starts to pass through the electroconductive layer efficiently.

Table 7 below shows a result of evaluation of constitutions, corresponding to P1 to P4 in FIG. 19, actually designed as fixing devices.

TABLE 7

| Plot | Range | D*1 (mm) | P*2 (%) | CE*3 (%) | ER*4 |
|---|---|---|---|---|---|
| P1 | — | 143.2 | 64.0 | 54.4 | IEP*5 |
| P2 | R1 | 127.3 | 71.2 | 70.8 | CM*6 |
| P3 | R2 | 63.7 | 91.7 | 83.9 | HRD*7 |
| P4 | R3 | 47.7 | 94.7 | 94.7 | OPTIMUM*8 |

*1"D" represents the electroconductive layer diameter.
*2"P" represents the proportion of the magnetic flux passing through the outside route of the electroconductive layer.
*3"CE" represents the electric power conversion efficiency.
*4"ER" represents an evaluation result in the case where the fixing device has a high specification.
*5"IEP" is that there is a possibility that the electric power becomes insufficient.
*6"CM" is that it is desirable that a cooling means is provided.
*7"HRD" is that it is desirable that heat-resistant design is optimized.
*8"OPTIMUM" is that the constitution is optimum for the flexible film.

(Fixing Device P1)

In this constitution, the cross-sectional area of the magnetic core is 26.5 $mm^2$ (5.75 mm×4.5 mm), the diameter of the electroconductive layer is 143.2 mm, and the proportion of the magnetic flux passing through the outside route is 64%. The electric power conversion efficiency, of this device, obtained by the impedance analyzer was 54.4%. The electric power conversion efficiency is a parameter indicating a degree (proportion) of electric power, contributing to heat generation of the electroconductive layer, of the electric power supplied to the fixing device. Accordingly, even when the constitution is designed as the fixing device capable of outputting 1000 W to the maximum, about 450 W is loss, and the less results in heat generation of the coil and the magnetic core.

In the case of this constitution, during rising, the coil temperature exceeds 200° C. in some cases even when 1000 W is supplied only for several seconds. When status that a heat-resistant temperature of an insulating member of the coils is high 200° C. and that the Courie point of the ferrite magnetic core is about 200° C. to about 250° C. in general are taken into consideration, at the loss of 45%, it becomes difficult to maintain the member such as the exciting coil at the heat-resistant temperature or less. Further, when the temperature of the magnetic core exceeds the Courie point, the coil inductance abruptly lowers, so that a load fluctuates.

About 45% of the electric power supplied to the fixing device is not used for heat generation of the electroconductive layer, and therefore in order to supply the electric power of 900 W (estimated as 90% of 1000 W) to the electroconductive layer, there is a need to supply electric power of about 1636 W. This means that a power source is such that 16.3 A is consumed when 100 V is inputted. Therefore, there is a possibility that the consumed current exceeds an allowable current capable of being supplied from an attachment plug of a commercial AC power source. Accordingly, in the fixing device P1 of 54.4% in electric power conversion efficiency, there is a possibility that the electric power to be supplied to the fixing device is insufficient.

(Fixing Device P2)

In this constitution, the cross-sectional area of the magnetic core is the same as the cross-sectional area in P1, the diameter of the electroconductive layer is 127.3 mm, and the proportion of the magnetic flux passing through the outside route is 71.2%. The electric power conversion efficiency, of this device, obtained by the impedance analyzer was 70.8%. In some cases, temperature rise of the coil and the core becomes problematic depending on the specification of the fixing device.

When the fixing device of this constitution is constituted as a device having a high specification such that a printing operation of 60 sheets/min, a rotational speed of the electroconductive layer is 330 mm/sec, so that there is a need to maintain the temperature of the electroconductive layer at 180° C. When the temperature of the electroconductive layer is intended to be maintained at 180° C., the temperature of the magnetic core exceeds 240° C. in 20 sec in some cases. The Courie temperature (point) of ferrite used as the magnetic core is ordinarily about 200° C. to about 250° C., and therefore in some cases, the temperature of ferrite exceeds the Courie temperature and the permeability of the magnetic core abruptly decreases, and thus the magnetic lines of force cannot be properly induced by the magnetic core. As a result, it becomes difficult to induce the loop current to cause the electroconductive layer to generate heat in some cases.

Accordingly, when the fixing device in which the proportion of the magnetic flux passing through the outside route is in the range R1 is constituted as the above-described high-specification device, in order to lower the temperature of the ferrite core, it is desirable that a cooling means is provided. As the cooling means, it is possible to use an air-cooling fan, water cooling, a cooling wheel, a radiation fin, heat pipe, Peltier element or the like. In this constitution, there is no need to provide the cooling means in the case where the high specification is not required to such extent.

(Fixing Device P3)

This constitution is the case where the cross-sectional area of the magnetic core is the same as the cross-sectional area in P1, and the diameter of the electroconductive layer is 63.7 mm. The electric power conversion efficiency, of this device, obtained by the impedance analyzer was 83.9%. Although the heat quantity is steadily-generated in the magnetic core, the coil and the like, a level thereof is not a level such that the cooling means is required.

When the fixing device of this constitution is constituted as a device having a high specification such that a printing operation of 60 sheets/min, a rotational speed of the electroconductive layer is 330 mm/sec, so that there is a need to maintain the surface temperature of the electroconductive layer at 180° C., but the temperature of the magnetic core (ferrite) does not increase to 220° C. or more. Accordingly, in this constitution, in the case where the fixing device is constituted as the above-described high-specification device, it is desirable that ferrite having the Courie temperature of 220° C. or more is used.

As described above, in the case where the fixing device in which the proportion of the magnetic flux passing through the outside route is in the range R2 is used as the high-specification device, it is desirable that heat-resistant design of ferrite or the like is optimized. On the other hand, in the case where the high specification is not required as the fixing device, such heat-resistant design is not needed.

(Fixing Device P4)

This constitution is the case where the cross-sectional area of the magnetic core is the same as the cross-sectional area in P1, and the diameter of the cylinder is 47.7 mm. The electric power conversion efficiency, of this device, obtained by the impedance analyzer was 94.7%.

When the fixing device of this constitution is constituted as a device having a high specification such that a printing operation of 60 sheets/min is performed, (rotational speed of electroconductive layer: 330 mm/sec), even in the case where the surface temperature of the electroconductive layer is maintained at 180° C., the temperatures of the exciting coil, the magnetic core and the like do not reach 180° C. or more. Accordingly, the cooling means for cooling the magnetic core, the coil and the like, and particular heat-resistant design are not needed.

As described above, in the range R3 in which the proportion of the magnetic flux passing through the outside route is 94.7% or more, the electric power conversion efficiency is 94.7% or more, and thus is sufficiently high. Therefore, even when the fixing device of this constitution is used as a further high-specification fixing device, the cooling means is not needed.

Further, in the range R3 in which the electric power conversion efficiency is stable at high values, even when an amount of the magnetic flux, per unit time, passing through the inside of the electroconductive layer somewhat fluctuates depending on a fluctuation in positional relationship between the electroconductive layer and the magnetic core, a fluctuation amount of the electric power conversion efficiency is small and therefore the heat generation amount of the electroconductive layer is stabilized. As in the case of the flexible film, in the fixing device in which a distance between the electroconductive layer and the magnetic core is liable to fluctuate, use of the range R3 in which the electric power conversion efficiency is stable at the high values has a significant advantage.

As described above, it is understood that in the fixing device in this embodiment, the proportion of the magnetic flux passing through the outside route is required to be 72% or more in order to satisfy at least the necessary electric power conversion efficiency. In Table 7, in the fixing device in this embodiment, the proportion of the magnetic flux passing through the outside route is 71.2% in the range R1, but in view of a measurement error or the like, the magnetic flux proportion is required to be 72% or more.

(5) Relational Expression of Permeance or Magnetic Reluctance to be Satisfied by Fixing Device The requirement that the proportion of the magnetic flux passing through the outside route of the electroconductive layer is 72% or more is equivalent to the requirement that the sum of the permeance of the electroconductive layer and the permeance of the induction (region between the electroconductive layer and the magnetic core) of the electroconductive layer is 28% or less of the permeance of the magnetic core.

Accordingly, one of the features of the constitution in this embodiment is that when the permeance of the magnetic core is Pc, the permeance of the inside of the electroconductive layer is Pa, and the permeance of the electroconductive layer is Ps, the following formula (529a) is satisfied.

$$0.28\times Pc\geq Ps+Pa \tag{529a}$$

When the relational expression of the permeance is replaced with a relational expression of the magnetic reluctance, the following formula (530) is satisfied.

$$0.28\times P_C \geq P_s + P_a \tag{530}$$

$$0.28\times \frac{1}{Rc} \geq \frac{1}{R_s} + \frac{1}{R_a}$$

$$0.28\times \frac{1}{Rc} \geq \frac{1}{R_{sa}}$$

$$0.28\times R_{sa} \geq Rc$$

However, a combined magnetic reluctance Rsa of Rs and Ra is calculated by the following formula (531).

$$\frac{1}{R_{sa}} = \frac{1}{R_s} + \frac{1}{R_a} \tag{531}$$

$$R_{sa} = \frac{R_a \times R_s}{R_a + R_s}$$

Rc: magnetic reluctance of the magnetic core

Rs: magnetic reluctance of the electroconductive layer

Ra: magnetic reluctance of the region between the electroconductive layer and the magnetic core Rsa: combined magnetic reluctance of Rs and Ra The above-described relational expression of the permeance or the magnetic reluctance may desirably be satisfied, in a cross-section perpendicular to the generatrix direction of the cylindrical rotatable member, over a whole of a maximum recording material reading region of the fixing device or over a maximum region through which the image on the recording material passes.

Similarly, in the fixing device in this embodiment, the proportion of the magnetic flux passing through the outside route is 92% or more in the range R2. In Table 7, in the fixing device in this embodiment, the proportion of the magnetic flux passing through the outside route is 91.7% in the range R2, but in view of a measurement error or the like, the magnetic flux proportion is 92%. The requirement that the proportion of the magnetic flux passing through the outside route of the electroconductive layer is 92% or more is equivalent to the requirement that the sum of the permeance of the electroconductive layer and the permeance of the induction (region between the electroconductive layer and the magnetic core) of the electroconductive layer is 8% or less of the permeance of the magnetic core.

Accordingly, the relational expression of the permeance is represented by the following formula (532).

$$0.08\times Pc\geq Ps+Pa \tag{532}$$

When the relational expression of the permeance is converted into a relational expression of the magnetic reluctance, the following formula (533) is satisfied.

$$0.08\times P_C\geq P_s+P_q\times 0.08\times R_{sa}\geq Rc \tag{533}$$

Further, in the fixing device in this embodiment, the proportion of the magnetic flux passing through the outside route is 95% or more in the range R3. In Table 7, in the fixing device in this embodiment, the proportion of the magnetic flux passing through the outside route is 94.7% in the range R3, but in view of a measurement error or the like, the magnetic flux proportion is 95%. The requirement that the proportion of the magnetic flux passing through the outside route of the electroconductive layer is 95% or more is equivalent to the requirement that the sum of the permeance of the electroconductive layer and the permeance of the induction (region between the electroconductive layer and the magnetic core) of the electroconductive layer is 5% or less of the permeance of the magnetic core.

Accordingly, the relational expression of the permeance is represented by the following formula (534).

$$0.05\times Pc\geq Ps+Pa \tag{534}$$

When the relational expression of the permeance is converted into a relational expression of the magnetic reluctance, the following formula (535) is satisfied.

$$0.05\times P_C\geq P_s+P_a$$

$$0.05 \times R_{sa} \geq Rc \quad (535)$$

Figure 20:
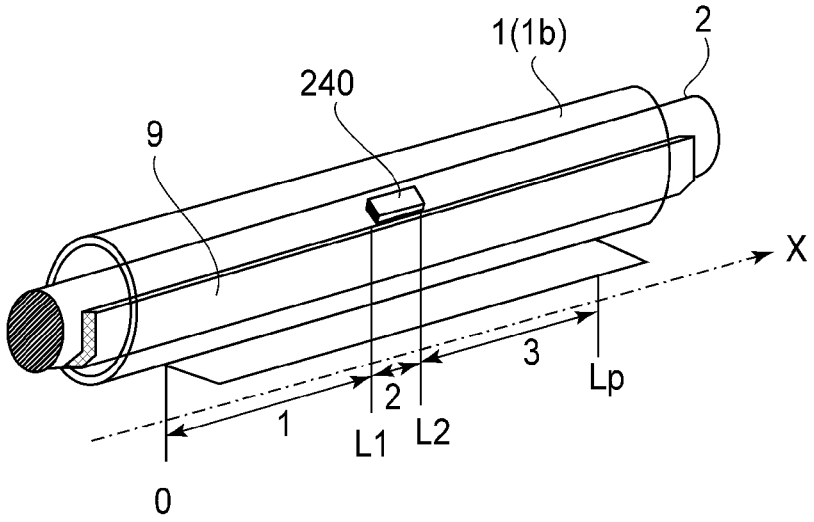
FIG. 20 is an illustration of a device structure including a temperature detecting member inside the electroconductive layer (in a region between the magnetic core and the electroconductive layer).

In the above, the relational expressions of the permeance and the magnetic reluctance in the fixing device in which the member or the like in the maximum image region of the fixing device has a uniform cross-sectional structure were shown. In the following, the fixing device in which the member or the like constituting the fixing device has a non-uniform cross-sectional structure with respect to the longitudinal direction will be described. In FIG. 20, a temperature detecting member 240 is provided inside (region between the magnetic core and the electroconductive layer) of the electroconductive layer 1*b*. Other constitutions are the same as those in the above embodiment, so that the fixing device includes the fixing sleeve 1 including the electroconductive layer 1*b*, and includes the magnetic core 2 and the fixing sleeve guide 9.

When the longitudinal direction of the magnetic core 2 is an X-axis direction, the maximum image forming region is a range from 0 to Lp on the X-axis. For example, in the case of the image forming apparatus in which the maximum recording material feeding region is the LTR size of 215.9 mm, Lp is 215.9 mm may only be satisfied.

The temperature detecting member 240 is constituted by a non-magnetic material of 1 in relative permeability, and is 5 mm×5 mm in cross-sectional area with respect to a direction perpendicular to the X-axis and 10 mm in length with respect to a direction parallel to the X-axis. The temperature detecting member 240 is disposed at position from L1 (102.95 mm) to L2 (112.95 mm) on the X-axis.

Here, on the X-axis, a region from 0 to L1 is referred to as region 1, a region from L1 to L2 where the temperature detecting member 240 exists is referred to as region 2, and a region from L2 to Lp is referred to as region 3. The cross-sectional structure in the region 1 is shown in (a) of FIG. 21, and the cross-sectional structure in the region 2 is shown in (b) of FIG. 21.

Figure 21:
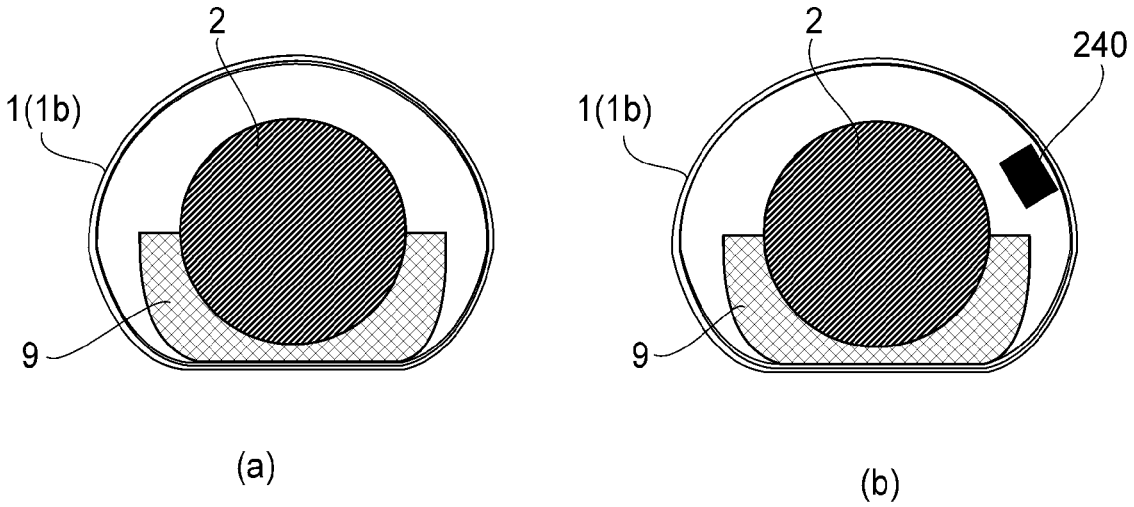
In FIG. 21, (a) and (b) are schematic cross-sectional structural views showing a portion of a region where the temperature detecting member does not exist in the device of FIG. 20 and a portion of a region where the temperature detecting member exists in the device of FIG. 20, respectively.

As shown in (b) of FIG. 21, the temperature detecting member 240 is incorporated in the fixing sleeve 1, and therefore is an object to be subjected to calculation of the magnetic reluctance. In order to strictly make the magnetic reluctance calculation, the "magnetic reluctance per unit length" in each of the regions 1, 2 and 3 is obtained separately, and integration calculation is made depending on the length of each region, and then the combined magnetic reluctance is obtained by adding up the integral values.

First, the magnetic reluctance per unit length of each of components (parts) in the region 1 or 3 is shown in Table 8.

TABLE 8

| Item | U*1 | MC*2 | SG*3 | IEL*4 | EL*5 |
|---|---|---|---|---|---|
| CSA*6 | $m^2$ | 1.5E−04 | 1.0E−04 | 2.0E−04 | 1.5E−06 |
| RP*7 | | 1800 | 1 | 1 | 1 |
| P*8 | H/m | 2.3E−03 | 1.3E−06 | 1.3E−06 | 1.3E−06 |
| PUL*9 | H · m | 3.5E−07 | 1.3E−10 | 2.5E−10 | 1.9E−12 |
| MRUL*10 | 1/(H/m) | 2.9E+06 | 8.0E+09 | 4.0E+09 | 5.3E+11 |

*1"U" is the unit.
*2"MC" is the magnetic core.
*3"SG" is the sleeve guide.
*4"IEL" is the inside of the electroconductive layer.
*5"EL" is the electroconductive layer.
*6"CSA" is the cross-sectional area.
*7"RP" is the relative permeability.
*8"P" is the permeability.
*9"PUL" is the permeance per unit length.
*10"MRUL" is the magnetic reluctance per unit length.

In the region 1, a magnetic reluctance per unit length (rc1) of the magnetic core is as follows.

$$rc1 = 2.9 \times 10^6 (1/(H \cdot m))$$

In the region between the electroconductive layer and the magnetic core, a magnetic reluctance per unit length ($r_a$) is a combined magnetic reluctance of a magnetic reluctance per unit length ($r_f$) of the fixing sleeve guide and a magnetic reluctance per unit length ($r_{air}$) of the inside of the electroconductive layer. Accordingly, the magnetic reluctance $r_a$ can be calculated using the following formula (536).

$$\frac{1}{r_a} = \frac{1}{r_f} + \frac{1}{r_{air}} \quad (536)$$

As a result of the calculation, a magnetic reluctance $r_{a1}$ in the region 1 and a magnetic reluctance $r_{s1}$ in the region 1 are follows.

$$r_{a1} = 2.7 \times 10^9 (1/(H \cdot m))$$

$$r_{s1} = 5.3 \times 10^{11} (1/(H \cdot m))$$

Further, the region 3 is equal in length to the region 1, and therefore magnetic reluctance values in the region 3 are as follows.

$$r_{c3} = 2.9 \times 10^6 (1/(H \cdot m))$$

$$r_{a3} = 2.7 \times 10^9 (1/(H \cdot m))$$

$$r_{a3} = 5.3 \times 10^{11} (1/(H \cdot m))$$

Next, the magnetic reluctance per unit length of each of components (parts) in the region 2 is shown in Table 9.

TABLE 9

| Item | U*1 | MC*2 | SG*3 | T*4 | IEL*5 | EL*6 |
|---|---|---|---|---|---|---|
| CSA*7 | $m^2$ | 1.5E−04 | 1.0E−04 | 2.5E−05 | 1.72E−04 | 1.5E−06 |
| RP*8 | | 1800 | 1 | 1 | 1 | 1 |
| P*9 | H/m | 2.3E−03 | 1.3E−06 | 1.3E−06 | 1.3E−06 | 1.3E−06 |
| PUL*10 | H.m | 3.5E−07 | 1.3E−10 | 3.1E−11 | 2.2E−10 | 1.9E−12 |
| MRUL*11 | 1/(H/m) | 2.9E+06 | 8.0E+09 | 3.2E+10 | 4.6E+09 | 5.3E+11 |

*1"U" is the unit.
*2"MC" is the magnetic core.
*3"SG" is the sleeve guide.
*4"T" is the thermistor.
*6"EL" is the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.

In the region 2, a magnetic reluctance per unit length (rc2) of the magnetic core is as follows.

$$rc2 = 2.9 \times 10^6 (1/(H \cdot m))$$

In the region between the electroconductive layer and the magnetic core, a magnetic reluctance per unit length ($r_a$) is a combined magnetic reluctance of a magnetic reluctance per unit length ($r_f$) of the fixing sleeve guide, a magnetic reluctance per unit length ($r_t$) of the thermistor and a magnetic reluctance per unit length ($r_{air}$) of the inside air of the electroconductive layer. Accordingly, the magnetic reluctance $r_a$ can be calculated using the following formula (537).

$$\frac{1}{r_a} = \frac{1}{r_t} + \frac{1}{r_f} + \frac{1}{r_{air}} \tag{537}$$

As a result of the calculation, a magnetic reluctance per unit length ($r_{a2}$) in the region 1 and a magnetic reluctance per unit length ($r_{s2}$) in the region 2 are follows. The region 3 is equal in calculating method to the region 1, and therefore the calculating method in the region 3 will be omitted.

$$r_{a2}=2.7\times10^{9}(1/(H\cdot m))$$

$$r_{s2}=5.3\times10^{11}(1/(H\cdot m))$$

The reason why $r_{a1}=r_{a2}=r_{a3}$ is satisfied with respect to the magnetic reluctance per unit length ($r_a$) of the region between the electroconductive layer and the magnetic core will be described. In the magnetic reluctance calculation in the region 2, the cross-sectional area of the thermistor 240 is increased, and the cross-sectional area of the inside air of the electroconductive layer is decreased. However, the relative permeability of both of the thermistor 240 and the electroconductive layer is 1, and therefore the magnetic reluctance is the same independently of the presence or absence of the thermistor 240 after all.

That is, in the case where only the non-magnetic material is disposed in the region between the electroconductive layer and the magnetic core, calculation accuracy is sufficient even when the calculation of the magnetic reluctance is similarly treated as in the case of the inside air. This is because in the case of the non-magnetic material, the relative permeability becomes a value almost close to 1. On the other hand, in the case of the magnetic material (such as nickel, iron or silicon steel), the magnetic reluctance in the region where the magnetic material exists may preferably be calculated separately from the material in another region.

Integration of magnetic reluctance R (A/Wb(1/h)) as the combined magnetic reluctance with respect to the generatrix direction of the electroconductive layer can be calculated using magnetic reluctance values r1, r2 and r3 (1/(H·m)) in the respective regions as shown in the following formula (538).

$$R = \int_0^{L1} r1\,dl1 + \int_{L1}^{L2} r2\,dl1 + \int_{L2}^{L\rho} r3\,dl1 = r1(L1-0) + r2(L2-L1) + r3(LP-L2) \tag{538}$$

Accordingly, a magnetic reluctance Rc (H) of the core in a section from one end to the other end in the maximum recording material feeding region can be calculated as shown in the following formula (539).

$$R_c = \int_0^{L1} r_c1\,dl1 + \int_{L1}^{L2} r_c2\,dl1 + \int_{L2}^{Lp} r_c3\,dl1 = r_c1(L1-0) + r_c2(L2-L1) + r_c3(LP-L2) \tag{539}$$

Further, a combined magnetic reluctance Ra (H) of the region, between the electroconductive layer and the magnetic core, in the section from one end to the other end in the maximum recording material feeding region can be calculated as shown in the following formula (540).

$$R_a = \int_0^{L1} r_a1\,dl1 + \int_{L1}^{L2} r_a2\,dl1 + \int_{L2}^{Lp} r_a3\,dl1 = r_a1(L1-0) + r_a2(L2-L1) + r_a3(LP-L2) \tag{540}$$

Further, a combined magnetic reluctance Rs (H) of the electroconductive layer in the section from one end to the other end in the maximum recording material feeding region can be calculated as shown in the following formula (541).

$$R_s = \int_0^{L1} r_s1\,dl1 + \int_{L1}^{L2} r_s2\,dl1 + \int_{L2}^{Lp} r_s3\,dl1 = r_s1(L1-0) + r_s2(L2-L1) + r_s3(LP-L2) \tag{541}$$

A calculation result in each of the regions 1, 2 and 3 is shown in Table 10.

TABLE 10

| Item | Region 1 | Region 2 | Region 3 | MCR*1 |
|---|---|---|---|---|
| ISP*2 | 0 | 102.95 | 112.95 | |
| IEP*3 | 102.95 | 112.95 | 215.9 | |
| D*4 | 102.95 | 10 | 102.95 | |
| pc*5 | 3.5E−07 | 3.5E−07 | 3.5E−07 | |
| rc*6 | 2.9E+06 | 2.9E+06 | 2.9E+06 | |
| Irc*7 | 3.0E+08 | 2.9E+07 | 3.0E+08 | 6.2E+08 |
| pm*8 | 3.7E−10 | 3.7E−10 | 3.7E−10 | |
| rm*9 | 2.7E+09 | 2.7E+09 | 2.7E+09 | |
| Irm*10 | 2.8E+11 | 2.7E+10 | 2.8E+11 | 5.8E+11 |
| ps*11 | 1.9E−12 | 1.9E−12 | 1.9E−12 | |
| rs*12 | 5.3E+11 | 5.3E+11 | 5.3E+11 | |
| Irs*13 | 5.4E+13 | 5.3E+12 | 5.4E+13 | 1.1E+14 |

*1"CMR" is the combined magnetic reluctance.
*2"ISP" is an integration start point (mm).
*3"IEP" is an integration end point (mm).
*4"D" is the distance (mm).
*5"pc" is the permeance per unit length (H · m).
*6"rc" is the magnetic reluctance per unit length (1/(h · m)).
*7"Irc" is integration of the magnetic reluctance rm (A/Wb(1/H)).
*8"pm" is the permeance per unit length (H · m).
*9"rm" is the magnetic reluctance per unit length (1/(h · m)).
*10"Irm" is integration of the magnetic reluctance rm (A/Wb(1/H)).
*11"ps" is the permeance per unit length (H · m).
*12"rs" is the magnetic reluctance per unit length (1/(h · m)).
*13"Irs" is integration of the magnetic reluctance rm (A/Wb(1/H)).

From Table 10, Rc, Ra and Rs are follows.

$$Rc=6.2\times10^{8}(1/H)$$

$$Ra=5.8\times10^{11}(1/H)$$

$$Rs=1.1\times10^{14}(1/H)$$

The combined magnetic reluctance Rsa of Rs and Ra can be calculated by the following formula (542).

$$\frac{1}{R_{sa}} = \frac{1}{R_s} + \frac{1}{R_a} \qquad R_{sa} = \frac{R_a \times R_s}{R_a + R_s} \tag{542}$$

From the above calculation, Rsa=$5.8\times10^{11}$ (1/h) holds, thus satisfying the following formula (543).

$$0.28\times R_{sa} \geq Rc \tag{543}$$

As described above, in the case of the fixing device in which a non-uniform cross-sectional shape is formed with respect to the generatrix direction of the electroconductive layer, the region is divided into a plurality of regions, and the magnetic reluctance is calculated for each of the divided regions, and finally, the combined permeance or magnetic reluctance may be calculated from the respective magnetic reluctance values. However, in the case where the member to be subjected to the calculation is the non-magnetic material, the permeability is substantially equal to the permeability of the air, and therefore the calculation may be made by regarding the member as the air.

Next, the component (part) to be included in the above calculation will be described. With respect to the component which is disposed between the electroconductive layer and the magnetic core and at least a part of which is placed in the maximum recording material feeding region (0 to Lp), it is desirable that the permeance or the magnetic reluctance thereof is calculated.

On the other hand, with respect to the component (member) disposed outside the electroconductive layer, there is no need to calculate the permeance or the magnetic reluctance thereof. This is because as described above, in the Faraday's law, the induced electromotive force is proportional to a change with time of the magnetic flux vertically passing through the circuit, and therefore is independent of the magnetic flux outside the electroconductive layer. Further, with respect to the member disposed out of the maximum recording material feeding region with respect to the generatrix direction of the electroconductive layer has no influence on the heat generation of the electroconductive layer, and therefore there is no need to make the calculation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 261298/2013 filed Dec. 18, 2013, which is hereby incorporated by reference.

What is claimed is:

1. An image heating apparatus for heating an image formed on a recording material, said image heating apparatus comprising:

a cylindrical rotatable member including a base layer and an electroconductive layer;

a helical coil disposed in a hollow portion of said rotatable member, said coil having a helical portion of which a helical axis extends along a generatrix direction of said rotatable member; and a magnetic core disposed in the helical portion of said coil, wherein an AC magnetic field, formed by an alternating current flowing through said coil, causes the electroconductive layer to generate heat through electromagnetic induction heating, wherein the base layer has a volume resistivity higher than that of the electroconductive layer, and a specific gravity smaller than that of the electroconductive layer, and wherein the electroconductive layer is formed of at least one of silver, aluminum, and austenitic stainless steel.

2. The image heating apparatus according to claim 1, wherein said core has a shape such that a loop is not formed outside the electroconductive layer.

3. The image heating apparatus according to claim 1, wherein the base layer is formed of a resin material.

4. The image heating apparatus according to claim 1, wherein the electroconductive layer has a thickness smaller than a thickness of the base layer.

5. The image heating apparatus according to claim 1, wherein when the volume resistivity of the electroconductive layer is p, a diameter of the electroconductive layer is D, a thickness of the electroconductive layer is t, a width of the electroconductive layer in the generatrix direction is W, and a loop resistance R of the electroconducitve layer is $\rho \times D/t \times W$, the loop resistance R satisfies $0.1\ m\Omega \leq R \leq 50\ m\Omega$.

* * * * *